US007657415B2

(12) United States Patent
Panga et al.

(10) Patent No.: US 7,657,415 B2
(45) Date of Patent: Feb. 2, 2010

(54) SUBTERRANEAN FORMATION TREATMENT METHODS USING A DARCY SCALE AND PORE SCALE MODEL

(75) Inventors: Mohan Panga, Houston, TX (US); Vemuri Balakotaiah, Bellaire, TX (US); Murtaza Ziauddin, Richmond, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 504 days.

(21) Appl. No.: 10/442,584

(22) Filed: May 21, 2003

(65) Prior Publication Data

US 2003/0225521 A1 Dec. 4, 2003

Related U.S. Application Data

(60) Provisional application No. 60/384,957, filed on May 31, 2002.

(51) Int. Cl.
*G06G 7/058* (2006.01)
*G06G 7/57* (2006.01)
*E21B 43/277* (2006.01)

(52) U.S. Cl. ..... 703/12; 166/270

(58) Field of Classification Search ..... None
See application file for complete search history.

(56) References Cited

U.S. PATENT DOCUMENTS 6,196,318 B1 3/2001 Gong et al. ..... 166/308

OTHER PUBLICATIONS

Golfier et al. (2002). J. Fluid Mech., vol. 457, pp. 213-254.*

Doane et al. (1999). J. Canadian Petroleum Technology, vol. 38, pp. 35-45.*

Brakel, Jaap, Modeling in Chemical Engineering, 2000, International Journal for Philosophy of Chemistry, vol. 6, pp. 101-116.*

Wang, Y., Hill, A. D., and Schechter, R. S. "*The Optimum Injection Rate for Matrix Acidizing of Carbonate Formations*," paper SPE 26578 presented at 1993 SPE Annual Technical Conference and Exhibition held in Houston, Texas, Oct. 3-6, 1993.

Buijse, M. A.,"*Understanding Wormholing Mechanisms Can Improve Acid Treatments in Carbonate Formations*," SPE Prod. & Facilities, 15 (3), 168-175, 2000.

Huang, T., Zhu, D. and Hill, A. D.: "*Prediction of Wormhole Population Density in Carbonate Matrix Acidizing*," paper SPE 54723 presented at the 1999 SPE European Formation Damage Conference held in The Hague, May 31-Jun. 1, 1999.

Hoefner M. L. and Fogler. H. S.: "*Pore Evolution and Channel Formation During Flow and Reaction in Porous Media*," AIChE J, 34, 45-54 (1988).

Fredd, C. N. and Fogler, H. S.: "*Influence of Transport and Reaction on Wormhole Formation in Porous Media*," AIChE J, 44, 1933-1949 (1998).

Pomès, V., Bazin, B., Golfier, F., Zarcone, C., Lenormand, R. and Quintard, M.: "*On the Use of Upscaling Methods to Describe Acid Injection in Carbonates*," paper SPE 71511 presented at 2001 SPE Annual Technical Conference and Exhibition held in New Orleans, Lousiana, Sep. 30-Oct. 3, 2001.

Golfier, F., Bazin, B., Zarcone, C., Lenormand, R., Lasseux, D. and Quintard, M.: "*On the ability of a Darcy-scale model to capture wormhole formation during the dissolution of a porous medium*," J. Fluid Mech., 457, 213-254 (2002).

Civan, Faruk, "*Scale effect on Porosity and Permeability: Kinetics, Model and Correlation*," AIChE J, 47, 271-287(2001).

Gupta, N. and Balakotaiah, V.:"*Heat and Mass Transfer Coefficients in Catalytic Monoliths*," Chem. Engg. Sci., 56, 4771-4786 (2001).

Balakotaiah, V. and West, D.H.: "*Shape Normalization and Analysis of the Mass Transfer Controlled Regime in Catalytic Monoliths*," Chem. Engg. Sci., 57,1269-1286 (2002.

Paccaloni, G. and Tambini, M.: "*Advances in Matrix Stimulation Technology*," J. Petrol. Tech, 256-263, Mar. 1993.

"*From matrix Acidizing to Acid Fracturing: A Laboratory Evaluation of Acid/Rock Interactions*," Feb. 2001, SPE Prod. & Facilities, 22-29.

SPE 37312—Reaction Rate and Fluid Loss: The Keys to Wormhole Initiation and Propagation in Carbonate Acidizing, T. HUang, A.D. Hill, R.S. Schechter—presented at the SPE International Symposium on oilfield Chemistry held in Houston, Texas, Feb. 18-21, 1997.

SPE 59537—Dynamic Model of Wormhole Formation Demonstrates Conditions for Effective Skin Reduction during Carbonate Matrix Acidizing—C.N. Fredd. Presented at the 2000 SPE Permian Basin Oil and Gas Recovery Conference in Midland, Texas Mar. 21-23, 2000.

SPE 71511—On the Use of Upscaling Methods to Describe Acid Injection in Carbonates—V. Pomes, B. Bazin, F. Golfier, C. Zarcone, R. Lenormand and M. Quintard—Presented at the 2001 SPE Annual Technical Conference and Exhibition held in New Orleans, Louisiana, Sep. 30-Oct. 3, 2001.

* cited by examiner

*Primary Examiner*—Marjorie Moran
*Assistant Examiner*—Jason M Sims
(74) *Attorney, Agent, or Firm*—David Cate; Robin Nava; Tom Mitchell

(57) ABSTRACT

Subterranean treatment formation using a model which takes into account the pore level physics by coupling the local pore scale phenomena to the macroscopic variables (Darcy velocity, pressure and reactant cup-mixing concentration) through the structure-property relationships (permeability-porosity, average pore size-porosity and interfacial area-porosity) and the dependence of the fluid-solid mass transfer coefficient and fluid phase dispersion coefficient on the evolving pore scale variables (average pore size, local Reynolds and Schmidt numbers).

20 Claims, 15 Drawing Sheets

SUBTERRANEAN FORMATION TREATMENT METHODS USING A DARCY SCALE AND PORE SCALE MODEL

REFERENCE TO RELATED PROVISIONAL APPLICATION

This application claims the benefit of U.S. Provisional Application Ser. No. 60/384,957, filed May 31, 2002.

BACKGROUND OF THE INVENTION

1. Field of the Invention

The present invention is generally related to hydrocarbon well stimulation, and is more particularly directed to a method for designing matrix treatment. The invention is particularly useful for designing acid treatment in carbonate reservoirs.

2. Discussion of the Prior Art

Matrix acidizing is a widely used well stimulation technique. The primary objective in this process is to reduce the resistance to the flow of reservoir fluids due to a naturally tight formation or damages. Acid dissolves the material in the matrix and creates flow channels that increase the permeability of the matrix. The efficiency of this process depends on the type of acid used, injection conditions, structure of the medium, fluid to solid mass transfer, reaction rates, etc. While dissolution increases the permeability, the relative increase in the permeability for a given amount of acid is observed to be a strong function of the injection conditions.

In sandstone reservoirs, reaction fronts tend to be uniform and flow channeling is not observed. In carbonate reservoirs, depending on the injection conditions, multiple dissolution patterns may be produced, varying from uniform, conical and wormhole types. At very low flow rates, acid is spent soon after it contacts the medium resulting in face dissolution. The dissolution patterns are observed to be more uniform at high flow rates. At intermediate flow rates, long conductive channels known as wormholes are formed. These channels penetrate deep into the formation and facilitate the flow of oil. Experiments conducted in carbonate cores have shown that the relative increase in permeability for a given amount of acid injected is observed to be higher in wormholes. Thus, for optimizing a stimulation treatment, it is desirable to identify the parameters (e.g: rate of injection, acid type, thickness and permeability of the damaged zone etc.) that will produce wormholes with optimum density and penetrating deep into the formation.

It is well known that the optimum injection rate depends on the reaction and diffusion rates of the acid species, concentration of the acid, length of the core sample, temperature, permeability of the medium etc. The influence of the above factors on the wormhole formation is studied in the experiments. Several theoretical studies have been conducted in the past to obtain an estimate of the optimum injection rate and to understand the phenomena of flow channeling associated with reactive dissolution in porous media. However, the existing models describe only a few aspects of the acidizing process and the coupling of the mechanisms of reaction and transport at various scales that play a key role in the estimation of optimum injection rate are not properly accounted for in these models.

Several models have been proposed that are based on the assumption of an existing wormhole. Reference is made for instance to Wang, Y., Hill, A. D., and Schechter, R. S.:"*The Optimum Injection Rate for Matrix Acidizing of Carbonate Formations,*" paper SPE 26578 presented at 1993 SPE Annual Technical Conference and Exhibition held in Houston, Tex., Oct. 3-6, 1993; Buijse, M. A.:"*Understanding Wormholing Mechanisms Can Improve Acid Treatments in Carbonate Formations,*" SPE Prod. & Facilities, 15 (3), 168-175, 2000; and Huang, T., Zhu, D. and Hill, A. D.: "*Prediction of Wormhole Population Density in Carbonate Matrix Acidizing,*" paper SPE 54723 presented at the 1999 SPE European Formation Damage Conference held in The Hague, May 31-Jun. 1, 1999.

These models are used to study the effect of fluid leakage, reaction kinetics etc., on the wormhole propagation rate and the effect of neighboring wormholes on growth rate of the dominant wormhole. The simple structure of these models offers the advantage of studying the reaction, diffusion and convection mechanisms inside the wormhole in detail. These models, however, cannot be used to study wormhole initiation and the effect of heterogeneities on wormhole formation.

Network models describing reactive dissolution have been presented in Hoefner M. L. and Fogler. H. S.: "*Pore Evolution and Channel Formation During Flow and Reaction in Porous Media,*" AIChE J, 34, 45-54 (1988); and Fredd, C. N. and Fogler, H. S.: "*Influence of Transport and Reaction on Wormhole Formation in Porous Media,*" AIChE J, 44, 1933-1949 (1998). These models represent the porous medium as a network of tubes interconnected to each other at the nodes. Acid flow inside these tubes is described using Hagen-Poiseuille relationship for laminar flow inside a pipe. The acid reacts at the wall of the tube and dissolution is accounted in terms of increase in the tube radius. Network models are capable of predicting the dissolution patterns and the qualitative features of dissolution like optimum flow rate, observed in the experiments. However, a core scale simulation of the network model requires huge computational power and incorporating the effects of pore merging and heterogeneities into these models is difficult. The results obtained from network models are also subject to scale up problems.

An intermediate approach to describing reactive dissolution involves the use of averaged or continuum models. Averaged models were used to describe the dissolution of carbonates by Pomès, V., Bazin, B., Golfier, F., Zarcone, C., Lenormand, R. and Quintard, M.: "*On the Use of Upscaling Methods to Describe Acid Injection in Carbonates,*" paper SPE 71511 presented at 2001 SPE Annual Technical Conference and Exhibition held in New Orleans, La., September 30-Oct. 3, 2001; and Golfier, F., Bazin, B., Zarcone, C., Lenormand, R., Lasseux, D. and Quintard, M.: "*On the ability of a Darcy-scale model to capture wormhole formation during the dissolution of a porous medium,*" J. Fluid Mech., 457, 213-254 (2002). Unlike the network models that describe dissolution from the pore scale and the models based on the assumption of existing wormholes, the averaged models describe dissolution at a scale much larger than the pore scale and much smaller than the scale of the core. This intermediate scale is also known as the Darcy scale.

Averaged models circumvent the scale-up problems associated with network models, can predict wormhole initiation, propagation and can be used to study the effects of heterogeneities in the medium on the dissolution process. The results obtained from the averaged models can be extended to the field scale. The success of these models depends on the key inputs such as mass transfer rates, permeability-porosity correlation etc., which depend on the processes that occur at the pore scale. The averaged model written at the Darcy scale requires these inputs from the pore scale. Since the structure of the porous medium evolves with time, a pore level calculation has to be made at each stage to generate inputs for the averaged equation.

Averaged equations used by Golfier et al. and Pomès et al. describe the transport of the reactant at the Darcy scale with a pseudo-homogeneous model, i.e., they use a single concentration variable. In addition, they assume that the reaction is mass transfer controlled (i.e. the reactant concentration at the solid-fluid interface is zero).

The inventors have found that most systems fall in between the mass transfer and kinetically controlled regimes of reaction where the use of a pseudo-homogeneous model (single concentration variable) is not sufficient to capture all the features of the reactive dissolution process qualitatively and that 'a priori' assumption that the system is in the mass transfer controlled regime, often made in the literature, may not retain the qualitative features of the problem.

It would be therefore desirable to provide an improved model for predicting the dissolution pattern during matrix stimulation of carbonates.

SUMMARY OF THE INVENTION

The present invention proposes to model a stimulation treatment involving a chemical reaction in a porous medium including describing the chemical reaction by coupling the reactions and mass transfer occurring at the Darcy scale and at the pore scale and considering the concentration $c_f$ of a reactant in the pore fluid phase and the concentration of said reactant $c_s$ at the fluid solid interface of a pore.

The present invention is particularly suitable for modeling acidizing treatment of subterranean formation, in particular matrix acidizing and acid fracturing. Apart from well stimulation, the problem of reaction and transport in porous media also appears in packed-beds, pollutant transport in ground water, tracer dispersion etc. The presence of various length scales and coupling between the processes occurring at different scales is a common characteristic that poses a big challenge in modeling these systems. For example, the dissolution patterns observed on the core scale are an outcome of the reaction and diffusion processes occurring inside the pores, which are of microscopic dimensions. To capture these large-scale features, efficient transfer of information on pore scale processes to larger length scales becomes important. In addition to the coupling between different length scales, the change in structure of the medium adds an extra dimension of complexity in modeling systems involving dissolution. The model of the present invention improves the averaged models by taking into account the fact that the reaction can be both mass transfer and kinetically controlled, which is notably the case with relatively slow-reacting chemicals such as chelants, while still authorizing that pore structure may vary spatially in the domain due for instance to heterogeneities and dissolution.

According to another embodiment of the present invention, both the asymptotic/diffusive and convective contributions are accounted to the local mass transfer coefficient. This allows predicting transitions between different regimes of reaction.

TWO-SCALE CONTINUUM MODEL

Figure 1:
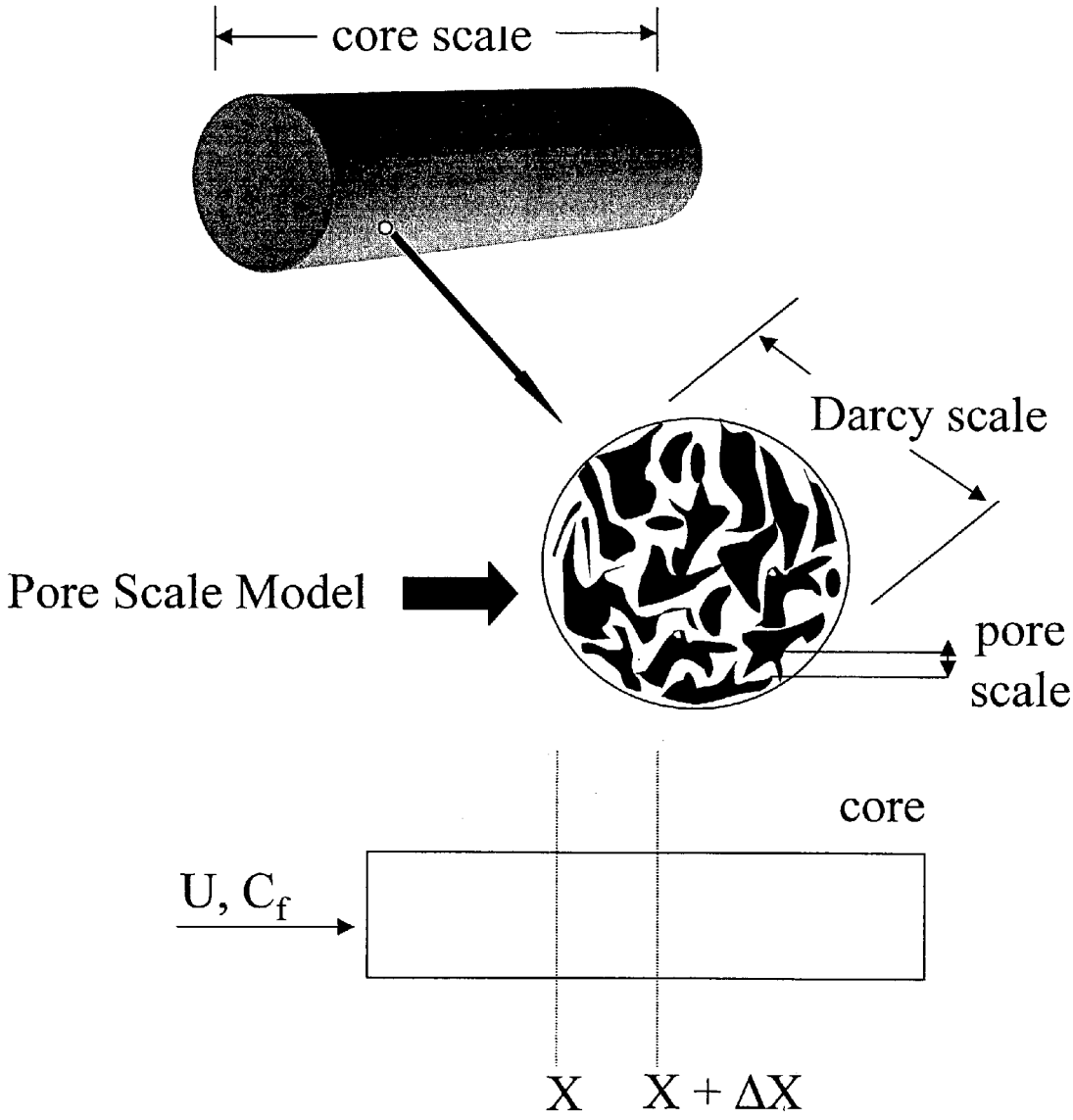
FIG. 1 is a schematic diagram showing different length scales in a porous medium.

Convection and diffusion of the acid, and reaction at the solid surface are the primary mechanisms that govern the dissolution process. Convection effects are important at a length scale much larger than the Darcy scale (e.g. length of the core), whereas, diffusion and reaction are the main mechanisms at the pore scale. While convection is dependent on the larger length scale, diffusion and reaction are local in nature i.e., they depend on the local structure of the pores and local hydrodynamics. The phenomenon of reactive dissolution is modeled as a coupling between the processes occurring at these two scales, namely the Darcy scale and the pore scale as illustrated FIG. 1. The two-scale model for reactive dissolution is given by Eqs. (1-5).

$$U = -\frac{1}{\mu} K \cdot \nabla P \tag{1}$$

$$\frac{\partial \varepsilon}{\partial t} + \nabla \cdot U = 0 \tag{2}$$

$$\varepsilon \frac{\partial C_f}{\partial t} + U \cdot \nabla C_f = \nabla (\varepsilon D_e \cdot \nabla C_f) - k_c a_v (C_f - C_s) \tag{3}$$

$$k_c a_v (C_f - C_s) = R(C_s) \tag{4}$$

$$\frac{\partial \varepsilon}{\partial t} = \frac{R(C_s) a_v \alpha}{\rho_s} \tag{5}$$

Here U=(U, V, W) is the Darcy velocity vector, K is the permeability tensor, P is the pressure, ε is the porosity, $C_f$ is the cup-mixing concentration of the acid in the fluid phase, $C_s$ is the concentration of the acid at the fluid-solid interface, $D_e$ is the effective dispersion tensor, $k_c$ is the local mass transfer coefficient, $a_v$ is the interfacial area available for reaction per unit volume of the medium, $\rho_s$ is the density of the solid phase and $\alpha$ is the dissolving power of the acid, defined as grams of solid dissolved per mole of acid reacted. The reaction kinetics are represented by $R(C_s)$. For a first order reaction $R(C_s)$ reduces to $k_sC_s$ where $k_s$ is the surface reaction rate constant having the units of velocity.

Equation (3) gives Darcy scale description of the transport of the acid species. The first three terms in the equation represent the accumulation, convection and dispersion of the acid respectively. The fourth term describes the transfer of the acid species from the fluid phase to the fluid-solid interface and its role is discussed in detail later in this section. The velocity field U in the convection term is obtained from Darcy's law (Eq. 1) relating velocity to the permeability field K and gradient of pressure. Darcy's law gives a good estimate of the flow field at low Reynolds number. For flows with Reynolds number greater than unity, the Darcy-Brinkman formulation, which includes viscous contribution to the flow, may be used to describe the flow field. Though the flow rates of interest here have Reynolds number less than unity, change in permeability field due to dissolution can increase the Reynolds number above unity. However, the Darcy's law, computationally less expensive than the Darcy-Brinkman formulation is preferably used for the present invention, though the model can be easily extended to the Brinkman formulation. The first term in the continuity Eq. (2) accounts for the effect of local volume change during dissolution on the flow field. While deriving the continuity equation, it is assumed that the dissolution process does not change the fluid phase density significantly.

The transfer term in the species balance Eq. (3) describes the depletion of the reactant at the Darcy scale due to reaction. An accurate estimation of this term depends on the description of transport and reaction mechanisms inside the pores. Hence a pore scale calculation on the transport of acid species to the surface of the pores and reaction at the surface is required to calculate the transfer term in Eq. (3). In the absence of reaction, the concentration of the acid species is uniform inside the pores. Reaction at the solid-fluid interface gives rise to concentration gradients in the fluid phase inside the pores. The magnitude of these gradients depends on the relative rate of mass transfer from the fluid phase to the fluid-solid interface and reaction at the interface. If the reaction rate is very slow compared to the mass transfer rate, the concentration gradients are negligible. In this case the reaction is considered to be in the kinetically controlled regime and a single concentration variable is sufficient to describe this situation. However, if the reaction rate is very fast compared to the mass transfer rate, steep gradients develop inside the pores. This regime of reaction is known as mass transfer controlled regime. To account for the gradients developed due to mass transfer control requires the solution of a differential equation describing diffusion and reaction mechanisms inside each of the pores. Since this is not practical, we use two concentration variables $C_s$ and $C_f$, one for the concentration of the acid at fluid-solid interface and the other for the concentration in the fluid phase respectively, and capture the information contained in the concentration gradients as a difference between the two variables using the concept of mass transfer coefficient.

Mathematical representation of the idea of transfer between the fluid phase and fluid-solid interface using two concentration variables and reaction at the interface is shown in Eq. (4). The l.h.s of equation represents the transfer between the phases using the difference between the concentration variables and mass transfer coefficient $k_c$. The amount of reactant transferred to the surface is equated to the amount reacted. For the case of first order kinetics ($R(C_s)=k_sC_s$) Eq. (4) can be simplified to $$C_s = \frac{C_f}{1 + \frac{k_s}{k_c}} \tag{6}$$

In the kinetically controlled regime, the ratio of $k_s/k_c$ is very small and the concentration at the fluid-solid interface is approximately equal to the concentration of the fluid phase ($C_s \sim C_f$). The ratio of $k_s/k_c$ is very large in the mass transfer controlled regime. In this regime, the value of concentration at the fluid-solid interface (Eq. (6)) is very small ($C_s \sim 0$). Since the rate constant is fixed for a given acid, the magnitude of the ratio $k_s/k_c$ is determined by the local mass transfer coefficient $k_c$. The mass transfer coefficient is a function of the pore size and local hydrodynamics. Due to dissolution and heterogeneity in the medium, the pore size and fluid velocity are both functions of position and time. Thus, the ratio of $k_s/k_c$ is not a constant in the medium but varies with space and time leading to a situation where different locations in the medium experience different regimes of reaction. To describe such a situation it is essential to account for both kinetic and mass transfer controlled regimes in the model, which is attained here using two concentration variables. A single concentration variable is not sufficient to describe both the regimes simultaneously.

The two-scale model can be extended to the case of complex kinetics by introducing the appropriate form of reaction kinetics $R(C_s)$ in Eq. (4). If the kinetics are nonlinear, equation (4) becomes a nonlinear algebraic equation which has to be solved along with the species balance equation. For reversible reactions, the concentration of the products affects the reaction rate, thus additional species balance equations describing the product concentration must be added to complete the model in the presence of such reactions. The change in local porosity is described with porosity evolution Eq. (5). This equation is obtained by balancing the amount of acid reacted to the corresponding amount of solid dissolved.

To complete the model Eqs. (1-5), information on permeability tensor K, dispersion tensor $D_e$, mass transfer coefficient $k_c$ and interfacial area $a_v$ is required. These quantities depend on the pore structure and are inputs to the Darcy scale model from the pore scale model. Instead of calculating these quantities from a detailed pore scale model taking into consideration the actual pore structure, we use structure-property relations that relate permeability, interfacial area and average pore radius of the pore scale model to its porosity. However, a detailed calculation including the pore structure could be made and the above quantities K, $D_e$, $k_c$ and $a_v$ obtained from the pore scale model can be passed on to the Darcy scale model. Here, we use the structure-property relations to study the trends in the behavior of dissolution for different types of structure-property relations and to reduce the computational effort involved in a detailed pore scale calculation.

Pore Scale Model

Structure-Property Relations

Dissolution changes the structure of the porous matrix continuously, thus making it difficult to correlate the changes in local permeability to porosity during acidization. The results obtained from the averaged models, which use these correlations, are subject to quantitative errors arising from the use of a bad correlation between the structure and property of the medium, though the qualitative trends predicted may be correct. Pore level modeling where the properties are calculated from a specified structure of the medium obviates the use of these correlations. In the absence of reaction where the structure of the matrix does not change, the properties predicted by pore level models could be representative of the real field case provided the specified structure is reasonably accurate. However, changes in the structure such as pore merging, changes in coordination number etc., caused by dissolution are difficult to incorporate into these models and hence the predictions may not be accurate or representative of what is observed. Since a definitive way of relating the changes in properties of the medium to the changes in structure does not exist, we use semi-empirical relations that relate the properties to parameters (e.g. porosity) that are measures of the structure of the medium. These relations offer the advantage of studying the sensitivity of the results to different qualitative trends between the structure and properties.

The permeability of the medium is related to its porosity using the relation (7) proposed by Civan in "*Scale effect on Porosity and Permeability: Kinetics, Model and Correlation,*" AIChE J, 47, 271-287(2001).

$$\sqrt{\frac{K}{\varepsilon}} = \gamma\left(\frac{\varepsilon}{1-\varepsilon}\right)^{\beta} \tag{7}$$

The parameters $\gamma$ and $\beta$ are empirical parameters introduced to account for dissolution. The parameters $\gamma$ and $1/\beta$ are observed to increase during dissolution and decrease for precipitation. In Eq. (7) the hydraulic diameter ($(K/\epsilon)^{1/2}$) is related to the ratio of pore volume to matrix volume. The permeability, average pore radius and interfacial area of the pore scale model are related to its initial values $K_o$, $a_o$, $r_o$ respectively in Eqs. (8)-(10).

$$\frac{K}{K_o} = \left(\frac{\gamma}{\gamma_o}\right)^2 \frac{\varepsilon}{\varepsilon_o}\left(\frac{\varepsilon(1-\varepsilon_o)}{\varepsilon_o(1-\varepsilon)}\right)^{2\beta} \tag{8}$$

$$\frac{r_p}{r_o} = \sqrt{\frac{K\varepsilon_o}{K_o\varepsilon}} = \left(\frac{\gamma}{\gamma_o}\right)\left(\frac{\varepsilon(1-\varepsilon_o)}{\varepsilon_o(1-\varepsilon)}\right)^{\beta} \tag{9}$$

$$\frac{a_v}{a_o} = \frac{\varepsilon r_o}{\varepsilon r_p} = \left(\frac{\gamma}{\gamma_o}\right)^{-1} \frac{\varepsilon}{\varepsilon_o}\left(\frac{\varepsilon(1-\varepsilon_o)}{\varepsilon_o(1-\varepsilon)}\right)^{-\beta} \tag{10}$$

Figure 2:
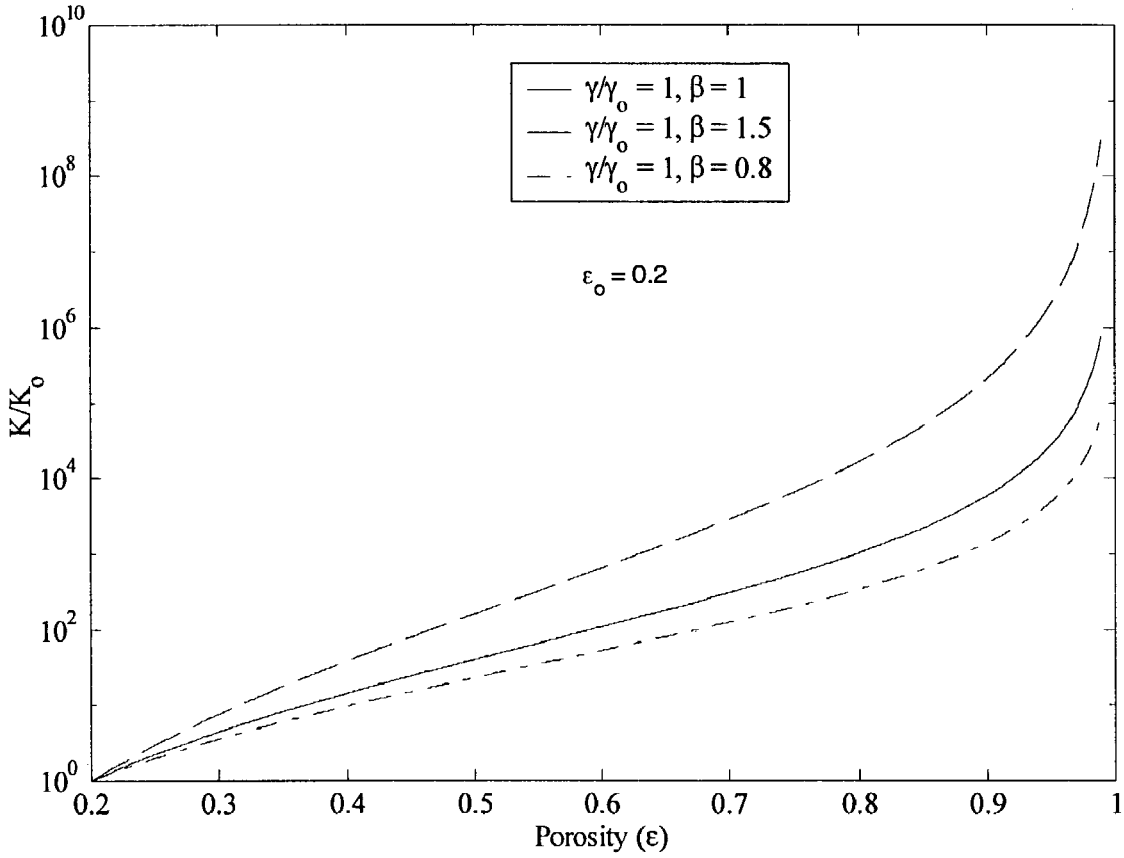
FIG. 2 is a plot of permeability versus porosity for different values of the empirical parameter β used in Equation (7)
Figure 3:
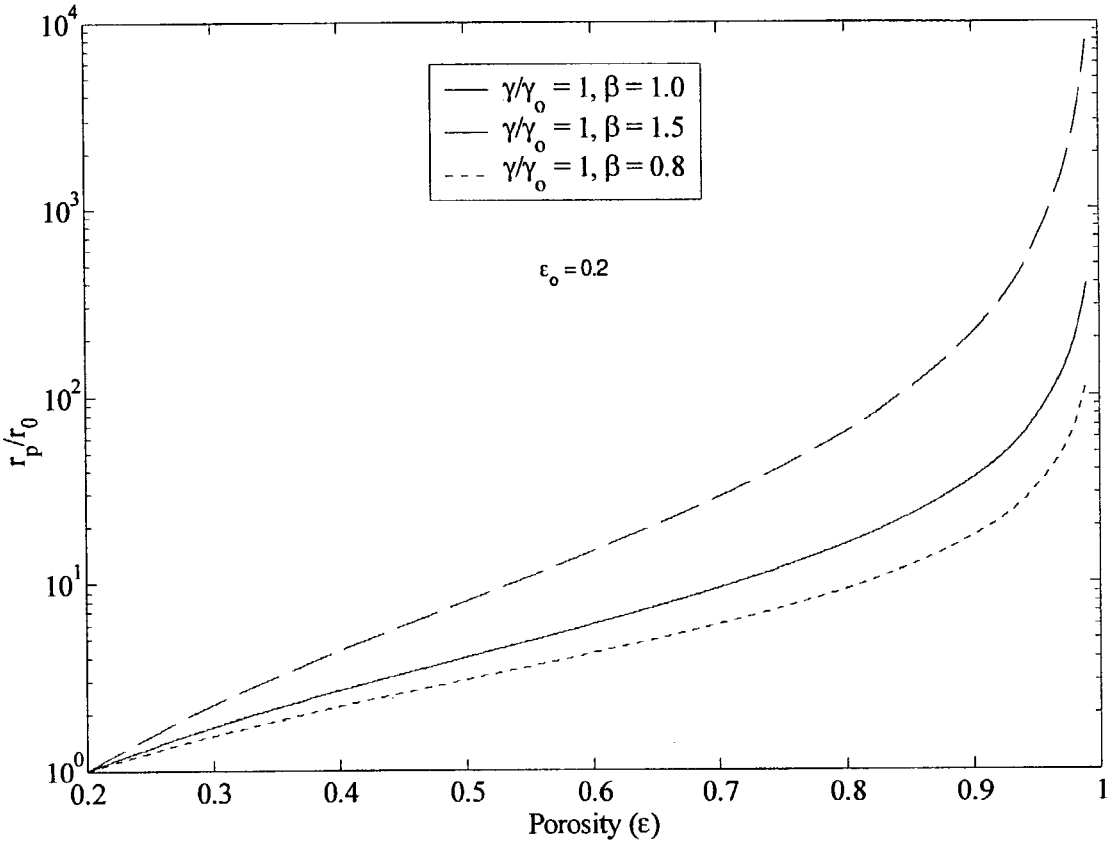
FIG. 3 is a plot showing the increase in pore radius with porosity as a function of β.
Figure 4:
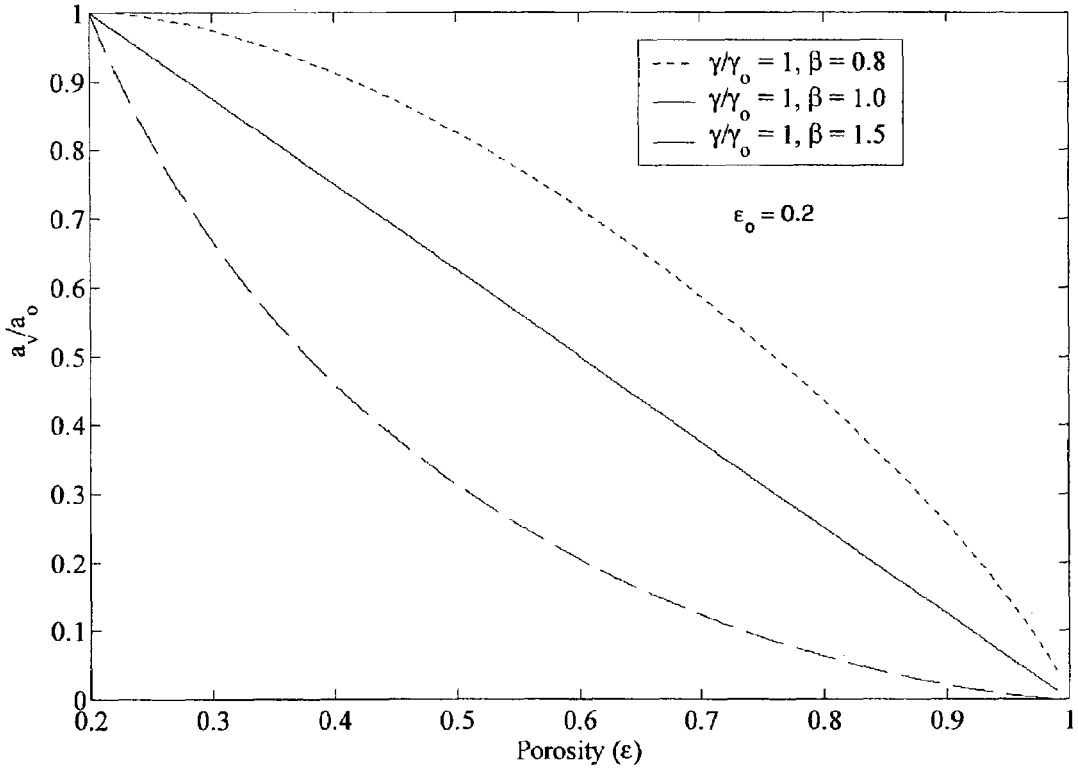
FIG. 4 is a plot showing the decrease in interfacial area with porosity as a function of β.

FIGS. 2, 3 and 4 show plots of permeability, pore radius and interfacial area versus porosity, respectively, for typical values of the parameters. The increase in porosity during dissolution decreases the interfacial area, which in turn reduces the reaction rate per unit volume. The decrease in interfacial area with increase in porosity is shown in FIG. 4. The model would yield better results if structure-property correlations that are developed for the particular system of interest are used. Note that, in the above relations permeability that is a tensor is reduced to a scalar for the pore scale model. In general, permeability is not isotropic when the pores are aligned preferentially in one direction. The assumption of isotropic permeability for the pore scale model is made here based on random orientation of pores without any preference for the direction. For the case where permeability is anisotropic, extra relations for the permeability of the pore scale model in the transverse directions may be used to complete the model.

Mass Transfer Coefficient

The rate of transport of acid species from the fluid phase to the fluid-solid interface inside the pores is quantified by the mass transfer coefficient. It plays an important role in characterizing dissolution phenomena because mass transfer coefficient determines the regime of reaction for a given acid (Eq. (6)). The local mass transfer coefficient depends on the local pore structure, reaction rate and local velocity of the fluid. The contribution of each of these factors to the local mass transfer coefficient is investigated in detail in references in Gupta, N. and Balakotaiah, V.:"*Heat and Mass Transfer Coefficients in Catalytic Monoliths,*" Chem. Engg. Sci., 56, 4771-4786 (2001) and in Balakotaiah, V. and West, D. H.: "*Shape Normalization and Analysis of the Mass Transfer Controlled Regime in Catalytic Monoliths,*" Chem. Engg. Sci., 57,1269-1286 (2002), both references hereby incorporated by reference.

For developing flow inside a straight pore of arbitrary cross section, a good approximation to the Sherwood number, the dimensionless mass transfer coefficient, is given by $$Sh = \frac{2k_c r_p}{D_m} = Sh_\infty + 0.35\left(\frac{d_h}{x}\right)^{0.5} \mathrm{Re}_p^{1/2} Sc^{1/3} \tag{11}$$

where $k_c$ is the mass transfer coefficient, $r_p$ is the pore radius and $D_m$ is molecular diffusivity, $Sh_\infty$ is the asymptotic Sherwood number for the pore, $Re_p$ is the pore Reynolds number, $d_h$ is the pore hydraulic diameter, x is the distance from the pore inlet and Sc is the Schmidt number ($Sc=\nu/D_m$; where $\nu$ is the kinematic viscosity of the fluid). Assuming that the length of a pore is typically a few pore diameters, the average mass transfer coefficient can be obtained by integrating the above expression over a pore length and is given by $$Sh = Sh_{28} + bRe_p^{1/2} Sc^{1/3} \tag{12}$$

where the constants $Sh_\infty$ and b ($=0.7/m^{0.5}$), m=pore length to diameter ratio) depend on the structure of the porous medium (pore cross sectional shape and pore length to hydraulic diameter ratio). Equation (12) is of the same general form as the Frossling correlation used extensively in correlating mass transfer coefficients in packed-beds. [For a packed bed of spheres, $Sh_\infty=2$ and b=0.6. This value of b is close to the theoretical value of 0.7 predicted by Eq. (12) for m=1.]

The two terms on the right hand side in correlation (12) are contributions to the Sherwood number due to diffusion and convection of the acid species, respectively. While the diffusive part, $Sh_\infty$, depends on the pore geometry, the convective part is a function of the local velocity. The asymptotic Sherwood number for pores with cross sectional shape of square, triangle and circle are 2.98, 2.50 and 3.66, respectively. Since the value of asymptotic Sherwood number is a weak function of the pore geometry, a typical value of 3.0 may be used for the calculations. The convective part depends on the pore Reynolds number and the Schmidt number. For liquids, the typical value of Schmidt number is around one thousand and assuming a value of 0.7 for b, the approximate magnitude of the convective part of Sherwood number from Eq. (12) is $7Re_p^{1/2}$. The pore Reynolds numbers are very small due to the small pore radius and the low injection velocities of the acid, making the contribution of the convective part negligible during initial stages of dissolution. As dissolution proceeds, the pore radius and the local velocity increase, making the convective contribution significant. Inside the wormhole, where the velocity is much higher than elsewhere in the medium, the pore level Reynolds number is high and the magnitude of the convective part of the Sherwood number could exceed the diffusive part. The effect of this change in mass transfer rate due to convection on the acid concentration may not be significant because of the extremely low interfacial area in the high porosity regions. The acid could be simply convected forward without reacting due to low interfacial area by the time the convection contribution to the mass transfer coefficient becomes important. Though the effect of convective part of the mass transfer coefficient on the acid concentration inside the wormhole is expected to be negligible, it is important in the uniform dissolution regime and to study the transitions between different reaction regimes occurring in the medium due to change in mass transfer rates.

The effect of reaction kinetics on the mass transfer coefficient is observed to be weak. For example, the asymptotic Sherwood number varies from 48/11 (=4.36) to 3.66 for the case of very slow reaction to very fast reaction. The correlation (12) accounts for effect of the three factors, pore cross sectional shape, local hydrodynamics and reaction kinetics on the mass transfer coefficient. The influence of tortuosity of the pore on the mass transfer coefficient is not included in the correlation. Intuitively, the tortuosity of the pore contributes towards the convective part of the Sherwood number. However, as mentioned above, the effect of convective part of the mass transfer coefficient on the acid concentration profile is negligible and does not affect the qualitative behavior of dissolution.

Fluid Phase Dispersion Coefficient

For homogeneous, isotropic porous media, the dispersion tensor is characterized by two independent components, namely, the longitudinal, $D_{eX}$ and transverse, $D_{eT}$, dispersion coefficients. In the absence of flow, dispersion of a solute occurs only due to molecular diffusion and $D_{eX}=D_{eT}=\alpha_o D_m$, where $D_m$ is the molecular diffusion coefficient and $\alpha_o$ is a constant that depends on the structure of the porous medium (e.g., tortuosity). With flow, the dispersion tensor depends on the morphology of the porous medium as well as the pore level flow and fluid properties. In general, the problem of relating the dispersion tensor to these local variables is rather complex and is analogous to that of determining the permeability tensor in Darcy's law from the pore structure. According to a preferred embodiment of the present invention, only simple approximations to the dispersion tensor are considered.

The relative importance of convective to diffusive transport at the pore level is characterized by the Peclet number in the pore, defined by $$Pe = \frac{|u| d_h}{D_m} \tag{13}$$

where |u| is the magnitude of the Darcy velocity and $d_h$ is the pore hydraulic diameter. For a well-connected pore network, random walk models and analogy with packed beds may be used to show that $$\frac{D_{eX}}{D_m} = \alpha_o + \lambda_X Pe \tag{14}$$

$$\frac{D_{eT}}{D_m} = \alpha_o + \lambda_T Pe \tag{15}$$

where $\lambda_X$ and $\lambda_T$ are numerical coefficients that depend on the structure of the medium ($\lambda_X \approx 0.5$, $\lambda_T \approx 0.1$ for packed-beds). Other correlations used for $D_{eX}$ are of the form $$\frac{D_{eX}}{D_m} = \alpha_o + \frac{1}{6} Pe \ln\left(\frac{3Pe}{2}\right) \tag{16}$$

$$\frac{D_{eT}}{D_m} = \alpha_o + \lambda_T Pe^2 \tag{17}$$

Equation (17) based on Taylor-Aris theory is normally used when the connectivity between the pores is very low. These as well as the other correlations in literature predict that both the longitudinal and transverse dispersion coefficients increase with the Peclet number. According to a preferred embodiment of the present invention, the simpler relation given by Eqs. (14) and (15) is used to complete the averaged model. In the following sections, the 1-D and 2-D versions of the two-scale model (1-5) are analyzed.

One-Dimensional Model

The one dimensional version of the model is analyzed in this section for the case of an irreversible reaction assuming linear kinetics ($R(C_s)=k_s C_s$). To identify the important dimensionless groups the equations are made dimensionless by choosing the length of the core L as the characteristic length scale in the flow direction, inlet velocity $u_o$ as the characteristic velocity and the inlet concentration $C_o$ as the characteristic concentration of the acid species. In 1-D, the dimensionless model for the case of constant injection rate is given by $$u = 1 - \int_0^x Da N_{ac} a c_s dx \tag{18}$$

$$\varepsilon \frac{\partial c_f}{\partial t} + u \frac{\partial c_f}{\partial x} = -Daa \frac{c_f}{\left(1 + \frac{\varphi^2 r}{Sh}\right)} \tag{19}$$

$$c_s = \frac{c_f}{\left(1 + \frac{\varphi^2 r}{Sh}\right)} \tag{20}$$

$$\frac{\partial \varepsilon}{\partial t} = Da N_{ac} a c_s \tag{21}$$

where u, $c_f$, $c_s$ and r are the dimensionless velocity, dimensionless fluid phase and fluid-solid interface concentrations and dimensionless pore radius, respectively. The definitions of the three dimensionless groups in the model Damköhler number Da, Thiele modulus $\phi^2$ and acid capacity number $N_{ac}$ are given below:

$$Da = \frac{k_s a_o L}{u_o}, \ \varphi^2 = \frac{2 k_s r_o}{D_m}, \ N_{ac} = \frac{\alpha C_o}{\rho_s}$$

where $a_o$ is the initial interfacial area per unit volume, $r_o$ is the initial average pore radius of the pore scale model and $\alpha$ is the acid dissolving power. The Damköhler number Da is the ratio of convective time $L/u_o$ to the reaction time $1/k_s a_o$ and the Thiele modulus $\phi^2$ (or the local Damköhler number) is the ratio of diffusion time $(2r_o)^2/D_m$ based on the initial average diameter $(2r_o)$ of the pore to the reaction time $k_s/(2r_o)$. While the Damköhler number is representative of the relative importance of reaction to convection at the Darcy scale, the Thiele modulus is representative of the importance of reaction to diffusion at the pore scale. The acid capacity number $N_{ac}$ is defined as the volume of solid dissolved per unit volume of the acid.

The velocity field in 1-D is described by Eq. (18) which is obtained by combining the continuity equation with the porosity evolution Eq. (21) and integrating once with respect to x using the boundary condition u=1 at the inlet. The integral in the equation is a correction to the velocity due to local volume change during dissolution. This term is negligible for small values of the product $DaN_{ac}$. For high values of $DaN_{ac}$ this term cannot be neglected. Since the calculations performed here are to study the qualitative behavior of dissolution, dispersion term in the species balance equation is neglected. Neglecting the dispersion term does not change the qualitative nature of the solution. Equation (20) is the dimensionless form of Eq. (6). The ratio ($\phi^2$r/Sh) is equal to the ratio of $k_s/k_c$ and the parameters $\phi^2$ and Sh depend only on the local reaction and mass transfer rates. This equation is called the local equation. In the following subsection local Eq. (20) is analyzed to identify different regimes of reaction and transitions between them.

Local Equation

As mentioned earlier, the magnitude of the term $\phi^2$r/Sh or $k_s/k_c$ in the denominator of the local equation determines whether the reaction is in kinetically controlled or mass transfer controlled regime. In practice, the reaction is considered to be in the kinetic regime if $\phi^2$r/Sh<0.1 and in the mass transfer controlled regime if $\phi^2$r/Sh>10. For values of $\phi^2$r/Sh between 0.1 and 10, the reaction is considered to be in the intermediate regime. The Thiele modulus $\phi^2$ in $\phi^2$r/Sh is defined with respect to initial conditions, but the dimensionless pore radius r and Sh change with position and time making the term $\phi^2$r/Sh a function of position and time. At any given time, it is difficult to ascertain whether the reaction in the entire medium is mass transfer controlled or kinetically controlled because these regimes of reaction are defined for a local scale and may not hold true for the entire system.

In the following table, the values of Thiele modulus for different acids are tabulated for initial pore radii in the range 1 μm-20 μm. Assuming a typical value of 3 for the Sherwood number, the initial values of $\phi^2$r/Sh(r=1) and the ratio of surface concentration $C_s$ to fluid phase concentration $C_f$ for different acids are listed in the table.

by a factor more than ten and the Sherwood number remains constant. However, the Sherwood number has both diffusion and convective contributions in it, and when the pore radius increases significantly, the Sherwood number also increases due to the convective contribution. This reduces the magnitude of $\phi^2$r/Sh (or $k_s/k_c$). Thus, the reaction may or may not reach a mass transfer limited regime with an increase in the pore radius. In this case, most of the reaction occurs in the intermediate regime and part of the reaction occurs in the mass transfer controlled regime because the interfacial area available for reaction is very low by the time the reaction reaches completely mass transfer controlled regime. Similar transitions between different reaction regimes can occur for the case of 0.25-M CDTA which is on the boundary of kinetic and intermediate regimes initially. In addition, heterogeneity (varying pore radius) in the medium can lead to different reaction regimes at different locations in the medium. The above discussion illustrates the complexity in describing transport and reaction mechanisms during dissolution due to transitions and heterogeneities. Nonetheless, these transitions are efficiently captured using two concentration variables in the local Eq. (20). A single concentration variable is not sufficient to describe both kinetic and mass transfer controlled regimes simultaneously.

Numerical Simulation of the 1-D Model

A parametric study of the one-dimensional model (18-21) is presented in this section. The results are compared to experimental observations in the next section. The three dimensionless parameters in the model are $\phi^2$, $N_{ac}$ and Da. Numerical simulations are performed by holding one of the parameters constant while varying the other two. A value of 0.2 is used for the initial porosity in all the simulations. The breakthrough of the acid is defined as an increase in the permeability of the core by a factor of 100 from its initial value ($K/K_o$=100).

Figure 5:
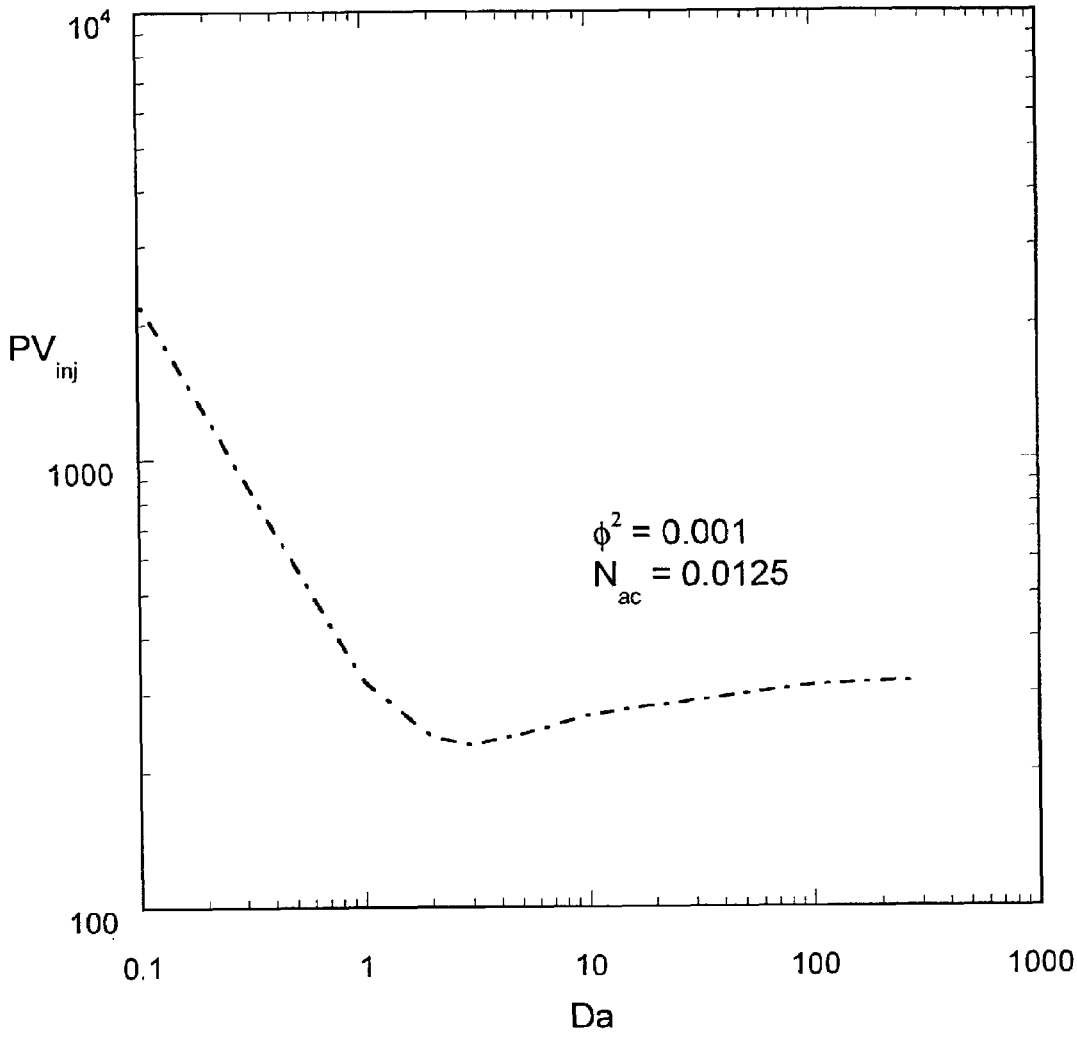
FIG. 5 is a plot showing the pore volumes required for breakthrough computed from the 1-D model versus Damköhler number for $\phi^2$=0.001 and $N_{ac}$=0.0125.

The value of $N_{ac}$ is fixed at 0.0125 in the first set of simulations. The Thiele modulus is varied between $\phi^2$=0.001 and $\phi^2$=100. The plot of pore volumes injected for breakthrough versus Damköhler number Da is shown in FIG. 5 for ($\phi^2$=0.001. The plot shows an optimum Damköhler number at which the number of pore volumes of acid required to break through the core is minimum. For very large and very small Damköhler numbers, the amount of acid required for break-

| Acid | $D_m$[cm²/s] | $k_s$[cm/s] | $\phi^2[r_o = 1\ \mu m]$ | $\phi^2[r_o = 20\ \mu m]$ | $\phi^2$r/Sh | $C_s/C_f$ |
|---|---|---|---|---|---|---|
| 0.25-M EDTA pH 13 | $6 \times 10^{-6}$ | $5.3 \times 10^{-5}$ | 0.0017 | 0.034 | 0.0006-0.0113 | 0.99-0.98 |
| 0.25-M DTPA pH 4.3 | $4 \times 10^{-6}$ | $4.8 \times 10^{-5}$ | 0.0024 | 0.048 | 0.0008-0.016 | 0.99-0.98 |
| 0.25-M EDTA pH 4 | $6 \times 10^{-6}$ | $1.4 \times 10^{-4}$ | 0.0046 | 0.092 | 0.0015-0.0306 | 0.99-0.97 |
| 0.25-M CDTA pH 4.4 | $4.5 \times 10^{-6}$ | $2.3 \times 10^{-4}$ | 0.01 | 0.2 | 0.003-0.06 | 0.99-0.94 |
| 0.5-M HCl | $3.6 \times 10^{-5}$ | $2 \times 10^{-1}$ | 1.11 | 22.2 | 0.37-7.4 | 0.73-0.135 |

Figure 6:
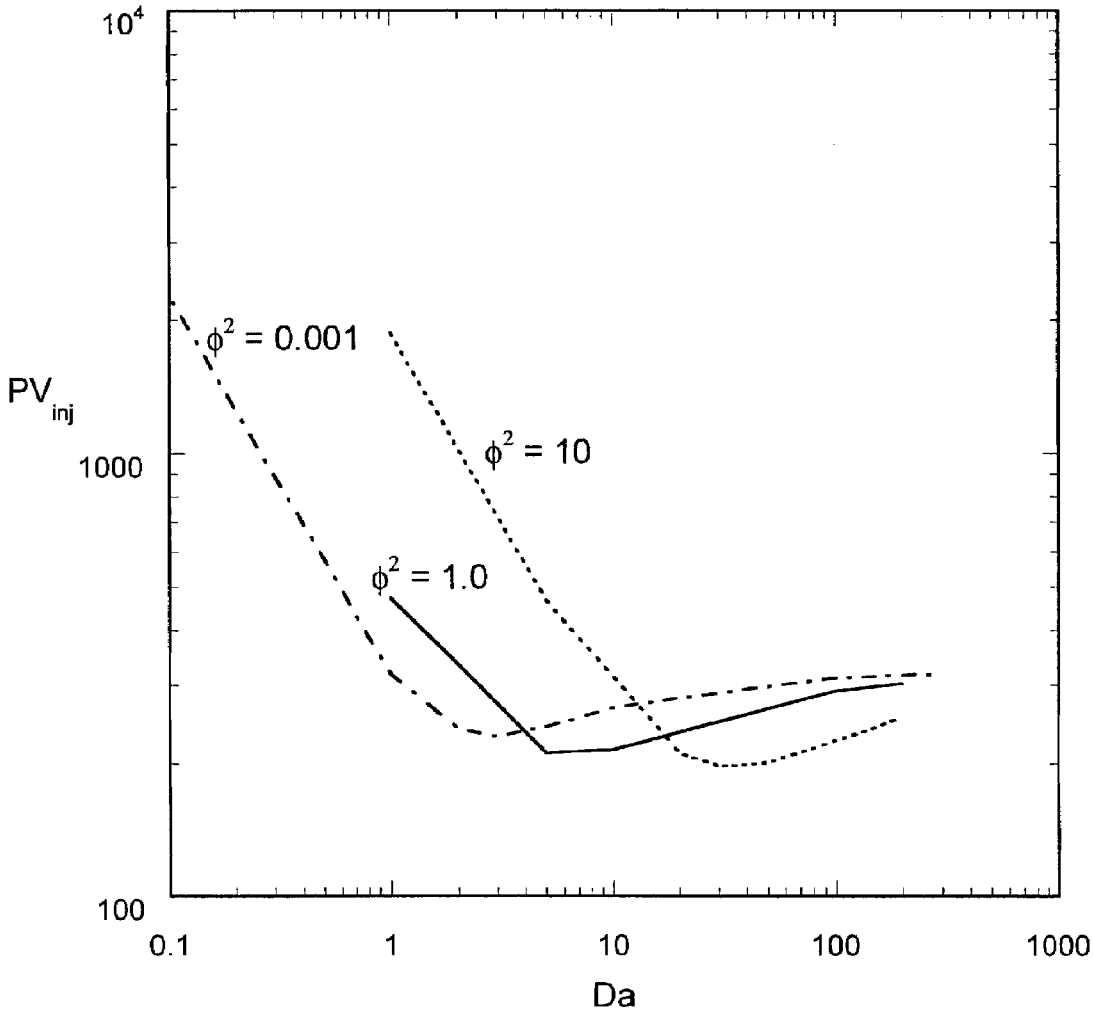
FIG. 6 is a plot showing the dependence of optimum Damköhler number on the Thiele modulus $\phi^2$.

The values of $\phi^2$/Sh and $C_s/C_f$ in the table show that all the above acids except HCl are in the kinetic regime during the initial stages of dissolution. The reaction between HCl and calcite is in the intermediate regime. As the reaction proceeds, the pore size becomes larger increasing the value of $\phi^2$r/Sh leading to transitions between different regimes of reaction. For example, the reaction between HCl and calcite will change from intermediate regime to completely mass transfer controlled regime if the dimensionless pore radius increases through is much higher. FIG. 6 shows the pore volumes required for breakthrough for $\phi^2$ values of 0.001, 1.0 and 10.0. As the value of $\phi^2$ increases the plot shows an increase in the optimum Damkohler number and decrease in the minimum pore volume required for breakthrough.

Figure 7:
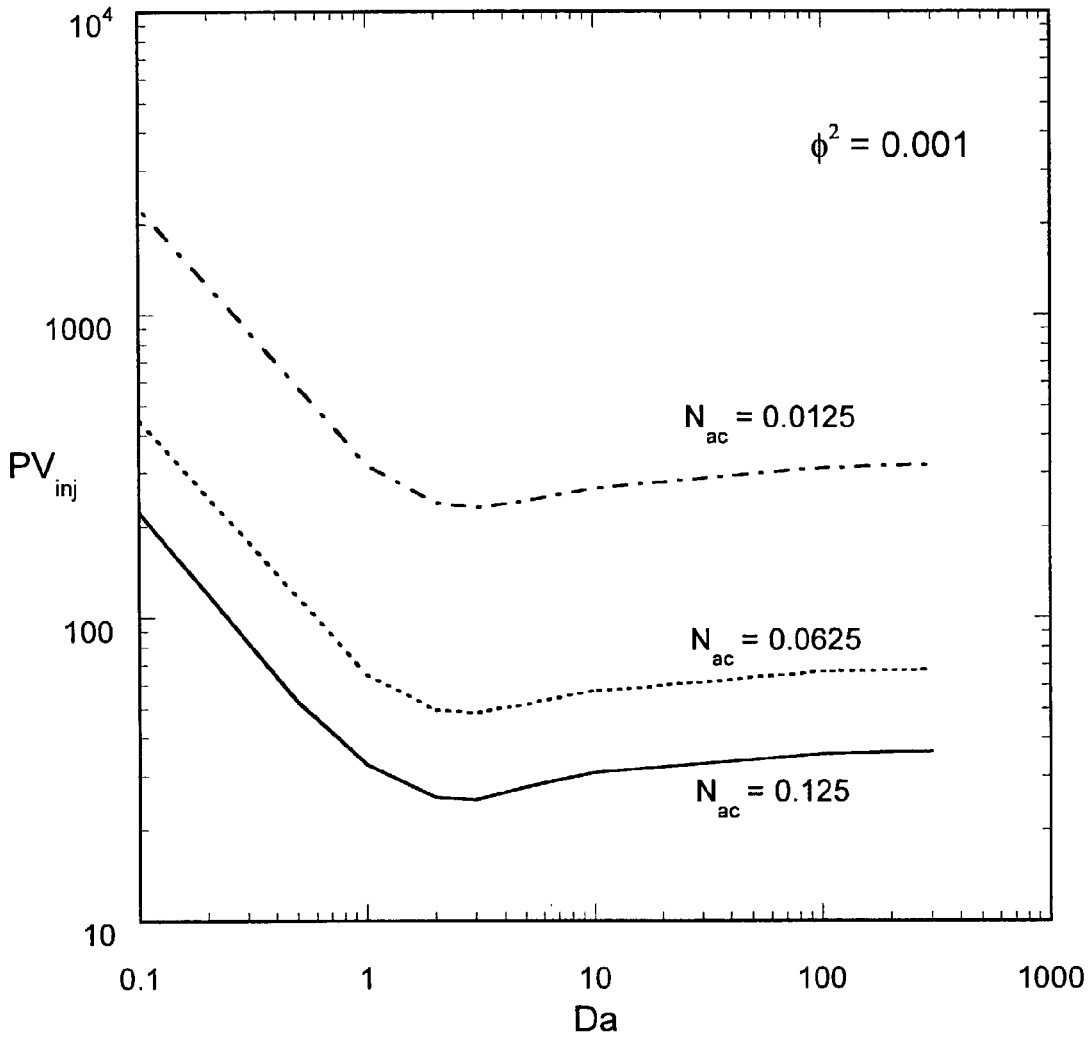
FIG. 7 is a plot showing the dependence of pore volumes required for breakthrough on the acid capacity number $N_{ac}$.
Figure 8:
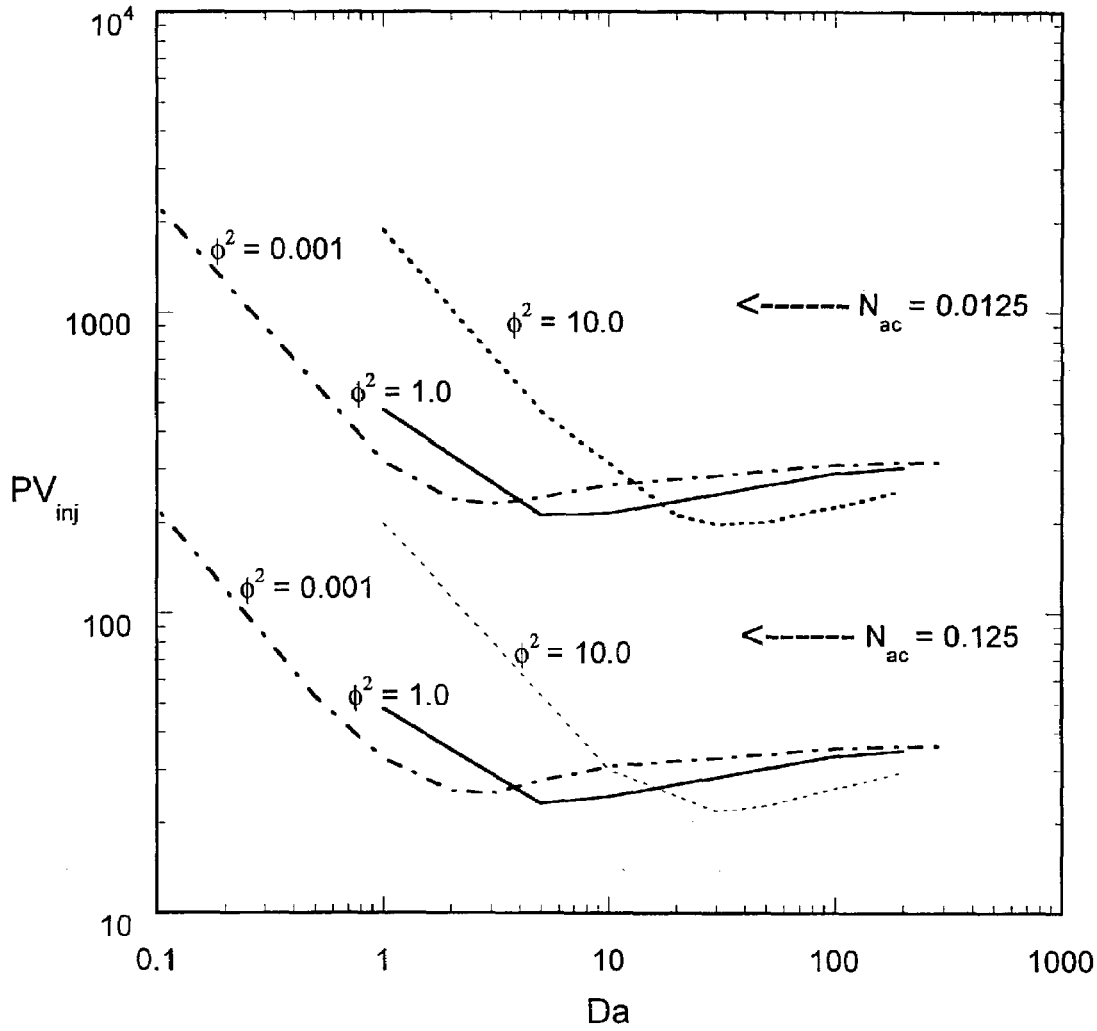
FIG. 8 is a plot showing the dependence of pore volumes to breakthrough and optimum Damköhler number on the parameters $\phi^2$ and $N_{ac}$.

In the second set of simulations presented here, the effect of acid capacity number $N_{ac}$ on the behavior of dissolution is investigated. FIG. 7 shows the plot of pore volumes injected for breakthrough versus Damköhler number for values of acid capacity number $N_{ac}$=0.0125, $N_{ac}$=0.0625 and $N_{ac}$=0.125 for the same Thiele modulus $\phi_2$=0.001. The minimum acid required for breakthrough decreases with increase in acid capacity number. This decrease in the minumum pore volumes is almost proportional to the increase in $N_{ac}$. FIG. 8 shows the plots of pore volumes injected versus Da where both $\phi^2$ and $N_{ac}$ are varied. The figure shows a horizontal shift in the curves when the Thiele modulus is increased and a vertical shift for an increase in the acid capacity number.

2-D Model

In this section, two-dimensional simulations that demonstrate the wormhole initiation, propagation, density, fluid leakage and competition between neighboring wormholes are presented. The effect of heterogeneity on the wormhole structure is investigated using different kinds of random permeability fields. The dimensionless two-dimensional model and the boundary conditions for constant injection rate used in the numerical simulations are shown below:

$$\frac{\partial}{\partial x}\left(\kappa\frac{\partial P}{\partial x}\right)+\frac{\partial}{\partial y}\left(\kappa\frac{\partial P}{\partial y}\right)=\frac{\partial \varepsilon}{\partial t} \tag{22}$$

$$\varepsilon\frac{\partial c_f}{\partial t}+u\frac{\partial c_f}{\partial x}+v\frac{\partial c_f}{\partial y}=-aDa\frac{c_f}{\left(1+\frac{\varphi^2 r}{Sh}\right)} \tag{23}$$

$$c_s=\frac{c_f}{\left(1+\frac{\varphi^2 r}{Sh}\right)} \tag{24}$$

$$\frac{\partial \varepsilon}{\partial t}=DaN_{ac}ac_s \tag{25}$$

$$c_f=1 \ @x=0 \tag{26}$$

$$\frac{q}{u_o L}=\frac{H}{L}=\alpha_o=\int_0^{\alpha_o}-\kappa\frac{\partial P}{\partial x}dy \quad @x=0 \tag{27}$$

$$P=0 \quad @x=1 \tag{28}$$

$$-\kappa\frac{\partial P}{\partial y}=0 \quad @y=0 \tag{29}$$

$$-\kappa\frac{\partial P}{\partial y}=0 \quad @y=\alpha_o \tag{30}$$

$$c_f=0 \ @t=0 \tag{31}$$

$$\epsilon=\epsilon_o+f \ @t=0 \tag{32}$$

Combining continuity equation with Darcy's law gives $$\frac{\partial \varepsilon}{\partial t}-\nabla\cdot(K\cdot\nabla p)$$

In Eq. (22) for the pressure field, the accumulation term $\partial\epsilon/\partial t$ is neglected assuming quasi steady state. The magnitude of $\partial\epsilon/\partial t$ is equal to $DaN_{ac}ac_s$. This term can be neglected if the product of Da and $N_{ac}$ is small. Equation (27) describes the constant injection rate boundary condition at the inlet, where $(q/u_oL)$ is the dimensionless injection rate, H is the width of the domain and $\alpha_o$ is the aspect ratio. The fluid is contained in the domain by preventing its leakage through the side walls using no flux boundary conditions at y=0 and y=H (Eqs. (29) and (30)). Heterogeneity is introduced in the domain as a random fluctuation f about a mean value $\epsilon_o$. The amplitude of f is varied from 10 to 50% about the mean value of porosity.

In the first step of the solution, pressure field in the medium is obtained by solving the algebraic equations resulting from the discretization of the above equation using the iterative solver GMRES (Generalized Minimal Residual Method). The flow profiles in the medium are calculated from the pressure profile using Darcy's law. Acid concentration in the medium is obtained by solving the species balance equation using an implicit scheme (Backward Euler). The porosity profile in the medium is then updated using the new values of concentration. This process is repeated till the breakthrough of the acid.

Dissolution Patterns and Dominant Wormhole Formation

At the inlet of the domain, injection rate of the acid is maintained constant. As the injection rate is varied different types of dissolution patterns similar to the patterns in experiments are observed. In the simulations, the aspect ratio and initial porosity of the medium are maintained at 1 and 0.2, respectively. The Damkohler number decreases as the injection rate increases. For very low injection rates (high Da) facial dissolution is observed. The acid is consumed completely as soon as it enters the medium. For higher injection rates, the acid channels through the medium producing a wormhole. In this case the acid escapes through the wormhole without affecting the rest of the medium. At very high injection rates, the acid dissolves the medium uniformly.

The formation of a dominant wormhole from the stage of initiation is desirable. A number of wormholes are initiated when the acid enters the medium. However, as the dissolution progresses, most of the acid is channeled into a few of these wormholes increasing their size. This preferential flow of acid into larger wormholes arrests the growth of smaller channels. Eventually, one of these three channels grows at a faster rate than the other two, drawing all the acid and thereby reducing their growth rate. In the above simulations the wormholes are initiated due to the heterogeneity in the medium and the competitive growth of wormholes can be seen from the figures.

Experimental Comparison

The effect of core length, acid concentration, temperature, diffusion and reaction rates on the optimum injection rate are investigated in the experimental studies. The influence of the each above factors on optimum rate of injection is studied separately using the model.

Core Length

Figure 9:
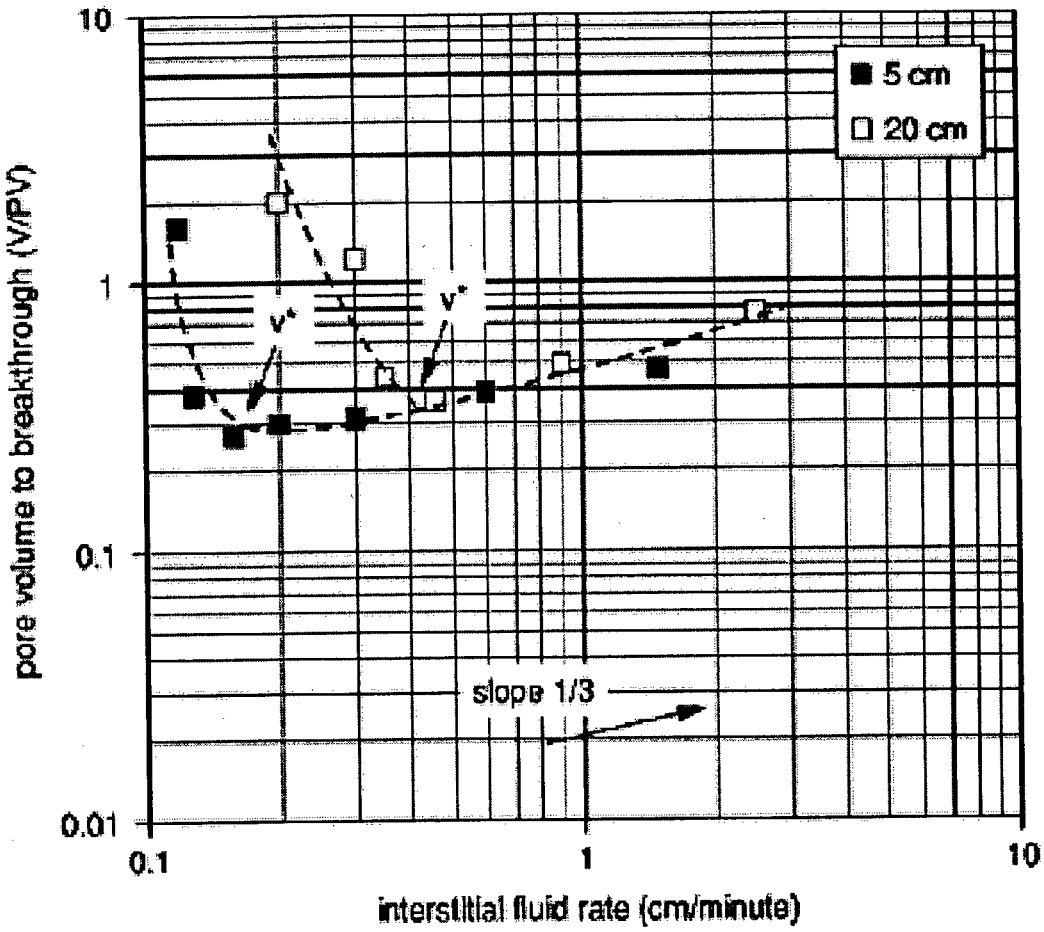
FIG. 9 is an experimental plot of pore volumes required for breakthrough versus injection rate for different core lengths.

The optimum injection rate is observed to increase with the core length. FIG. 9 shows the experimental data on pore volumes required for breakthrough versus injection velocity reported in [4] for two different core lengths 5 cm and 20 cm. The acid used in these experiments is 7% HCl. In terms of dimensionless numbers, the acid capacity number $N_{ac}$ and the Thiele modulus $\phi^2$ are fixed because the quantities on which these parameters depend, acid concentration, reaction and diffusion rates are constant in these experiments. For fixed values of $N_{ac}$ and $\phi^2$, the theoretical prediction of the model on optimum flow rate is similar to that shown in FIG. 5, except that the Thiele modulus and optimum Damköhler number are different. Since the optimum Damköhler number is fixed for fixed values of $N_{ac}$ and $\phi^2$, the optimum injection rates in the two experiments can be related by $$(Da_{opt})_1 = (Da_{opt})_2 \tag{33}$$

$$\frac{L_1}{u_1} = \frac{L_2}{u_2}$$

$$u_2 = \frac{L_2}{L_1}u_1$$

Using Eq. (33), the optimum injection rate for a core length of 20 cm can be obtained from the optimum injection rate of 5 cm core. The value of optimum injection rate for the 20 cm core is approximately $u_2$=((20)/5)(0.15)=0.6 cm/min, which is close to the experimentally observed injection rate.

The result in Eq. (33) when extended to the reservoir scale ($L_2/L_1 \rightarrow \infty$), suggests that the maximum wormhole length is achieved when the acid is injected at the maximum possible rate. This design of injecting the acid at maximum possible injection rate and pressure below the fracture pressure has been suggested by Williams, B. B., Gidley, J. L., and Schechter, R. S.: *Acidizing Fundamentals*, SPE Monograph Series, 1979, and is observed to increase the efficiency of stimulation in some field studies conducted by Paccaloni, G. and Tambini, M.: "*Advances in Matrix Stimulation Technology,*" J. Petrol. Tech, 256-263, March 1993. Bazin in "*From matrix Acidizing to Acid Fracturing: A Laboratory Evaluation of Acid/Rock Interactions,*" February 2001, SPE Prod. & Facilities, 22-29, made similar observations in experimental studies using cores of different lengths.

Acid Concentration

Figure 10:
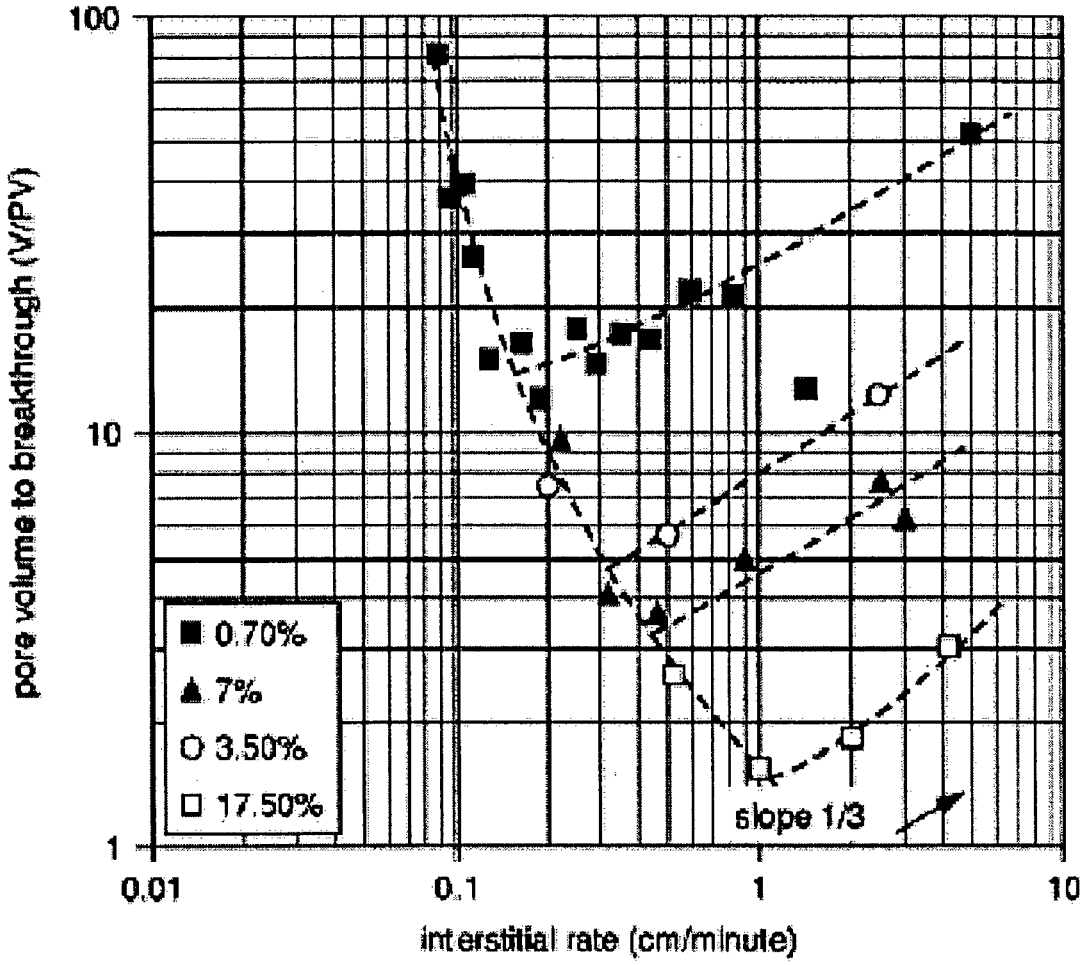
FIG. 10 is an experimental plot showing the decrease in optimum pore volumes required for breakthrough with increase in acid concentration.

FIG. 10 shows the effect of different acid concentrations, 0.7%, 3.5%, 7% and 17.5% HCl, on pore volume to breakthrough observed in the experiments performed by Bazin. The figure shows a decrease in the pore volumes and an increase in the optimum injection rate required for breakthrough with increase in concentration of the acid. The change in acid concentration affects only the acid capacity number $N_{ac}$ for a first order reaction. For a given acid or a fixed Thiele modulus $\phi^2$, FIG. 8 shows that increasing the acid capacity number or equivalently increasing the acid concentration decreases the pore volumes required for breakthrough.

Temperature

Figure 11:
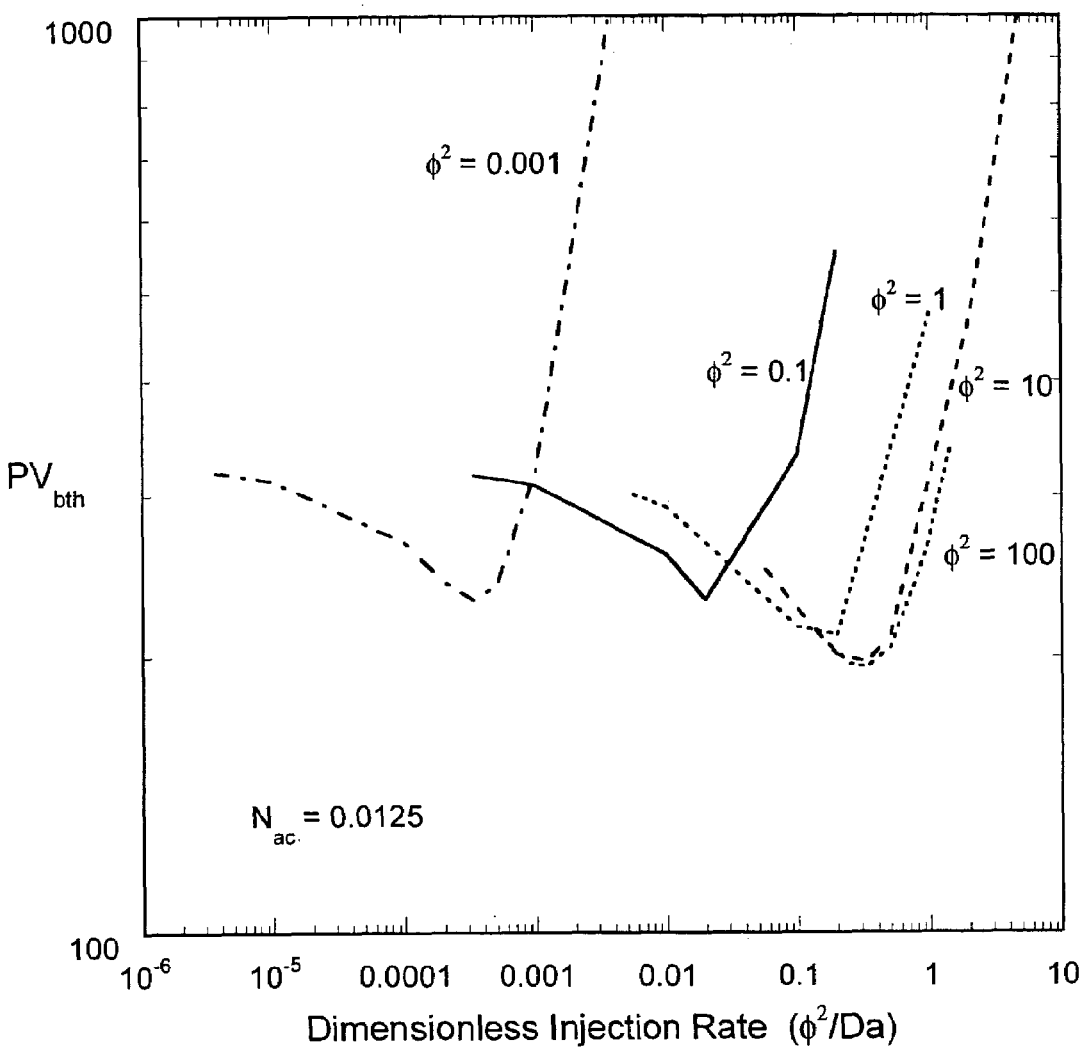
FIG. 11 shows the simulation results of 1-D model according to the invention, illustrating the shift in the optimum injection rate with increase in the Thiele modulus $\phi^2$.

The optimum injection rate is observed to increase with temperature. The reaction rate constant increases with increase in temperature, thereby increasing the Thiele modulus $\phi^2$. FIG. 11 shows the increase in dimensionless injection rate ($(\phi^2/Da=2r_o u_o/(D_m a_o L))$ or different values of Thiele modulus that correspond to the same acid at different temperatures, obtained from the 1-D model. The acid capacity number for all the simulations is 0.0125. The figure shows an increase in the dimensionless injection rate with increase in temperature or low to intermediate values of $\phi^2$. However, for very high values of Thiele modulus the dependence of dimensionless injection rate on the Thiele modulus is observed to be very weak. At very high temperatures (or large Thiele modulus), the reaction is completely mass transfer controlled and the surface reaction rate or Thiele modulus plays a minor role in the behavior of dissolution. Thus, the optimum injection rate is a weak function of the surface reaction rate in the completely mass transfer controlled process.

Acid Diffusion Rate

Figure 12:
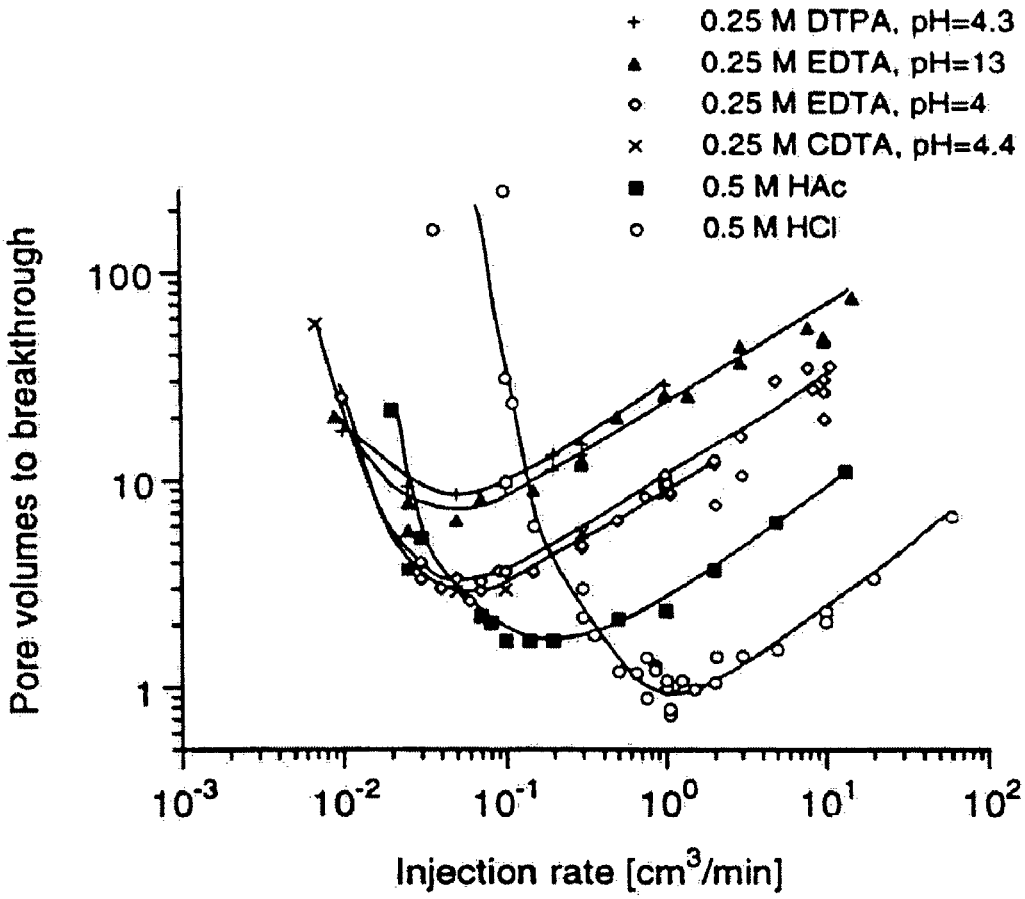
FIG. 12 is an experimental plot of pore volumes required for breakthrough versus injection rate for different acids.
Figure 13:
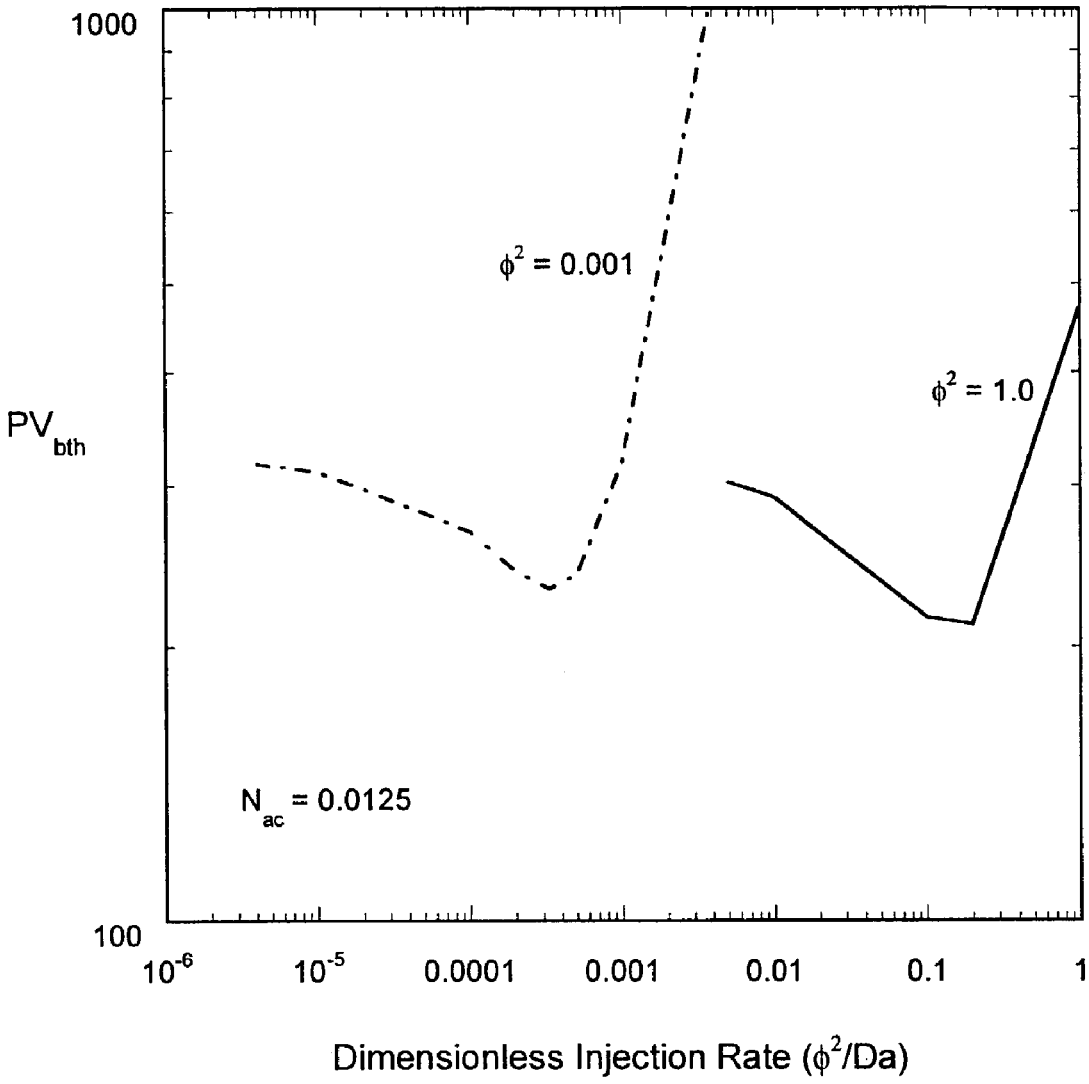
FIG. 13 shows the increase in the optimum injection rate predicted by the 1-D model according to the present invention with increase in the Thiele modulus $\phi^2$.

Fredd and Fogler performed experiments using acids with different diffusion rates with the same acid capacity number. FIG. 12 shows the optimum injection rate curves for these acids as a function of the injection rate. However, in these experiments the acid reaction rates are also different, thus both the rate constant $k_s$ and molecular diffusivity $D_m$ in the Thiele modulus are varied in these experiments. The values of Thiele modulus for different acids used in these experiments are listed in Table 1. Since the acid capacity number $N_{ac}$ is maintained constant in these experiments, dissolution behavior is only a function of the Thiele modulus $\phi^2$ and the Damköhler number Da. FIG. 12 shows that the curves corresponding to 0.25 M DTPA and 0.25M EDTA (pH=13) are very close to each other. This behavior could be a result of the values of Thiele modulus of the two acids, $\phi^2$=0.0017 and $\phi^2$=0.0024 for DTPA, being almost equal. The optimum injection rate of HCl is much higher because of the larger value of Thiele modulus $\phi^2$=1. The qualitative trend in increase in the injection rate with the acid Thiele modulus $\phi^2$ predicted by the 1-D model is shown in FIG. 13.

Breakthrough Volume

The one-dimensional model predicts qualitatively the dependence of optimum injection rate and pore volume to breakthrough on various factors. However, the optimum pore volume required for breakthrough is over predicted when compared to the experimental results. For example, the model predicts approximately 200 pore volumes at optimal conditions for HCl to breakthrough (FIG. 13), whereas the experimental value is close to one in FIG. 12. Similar discrepancy between experimental value and model prediction (approximately 500 pore volumes) is observed in the 2D network model developed by Fredd & Fogler. The reason for this difference is due to the velocity profile (Eq. (18)) used in the 1-D model. During dissolution, the acid channels into the conductive regions resulting in an increase in the local velocity. For constant injection rate, if we consider a core of 3.8 cm diameter used in the experiments and a wormhole of a 3.8 mm diameter, the velocity inside the wormhole could be much higher than the inlet velocity as shown in the following calculation.

$$u_w \sim \frac{A_{core}}{A_{wormhole}}u_{inlet} = \left(\frac{38}{3.8}\right)^2 u_{inlet} = 100u_{inlet} \tag{34}$$

Here, $u_w$ is the velocity inside the wormhole, $u_{inlet}$ is the injection velocity, $A_{core}$ and $A_{wormhole}$ are the cross sectional areas of the core and wormhole respectively. This increase in the velocity inside the domain due to channeling is not included in the 1-D velocity profile Eq. (18) where the maximum velocity inside the domain cannot be higher than the inlet velocity.

Since the 2-D model includes channeling effect on the velocity profile, the pore volume required for breakthrough is found to be significantly lower than the value predicted by the 1-D model. However, the value obtained from the 2-D model is still higher than the experimental result because the maximum velocity inside the domain would not increase as the square of the ratio of diameters (Eq. (34)) of the wormhole and the core, but as the ratio of diameters in two dimensions. It is believed that a complete 3-D simulation would predict approximate pore volumes required for breakthrough as observed in the experiments.

Figure 14:
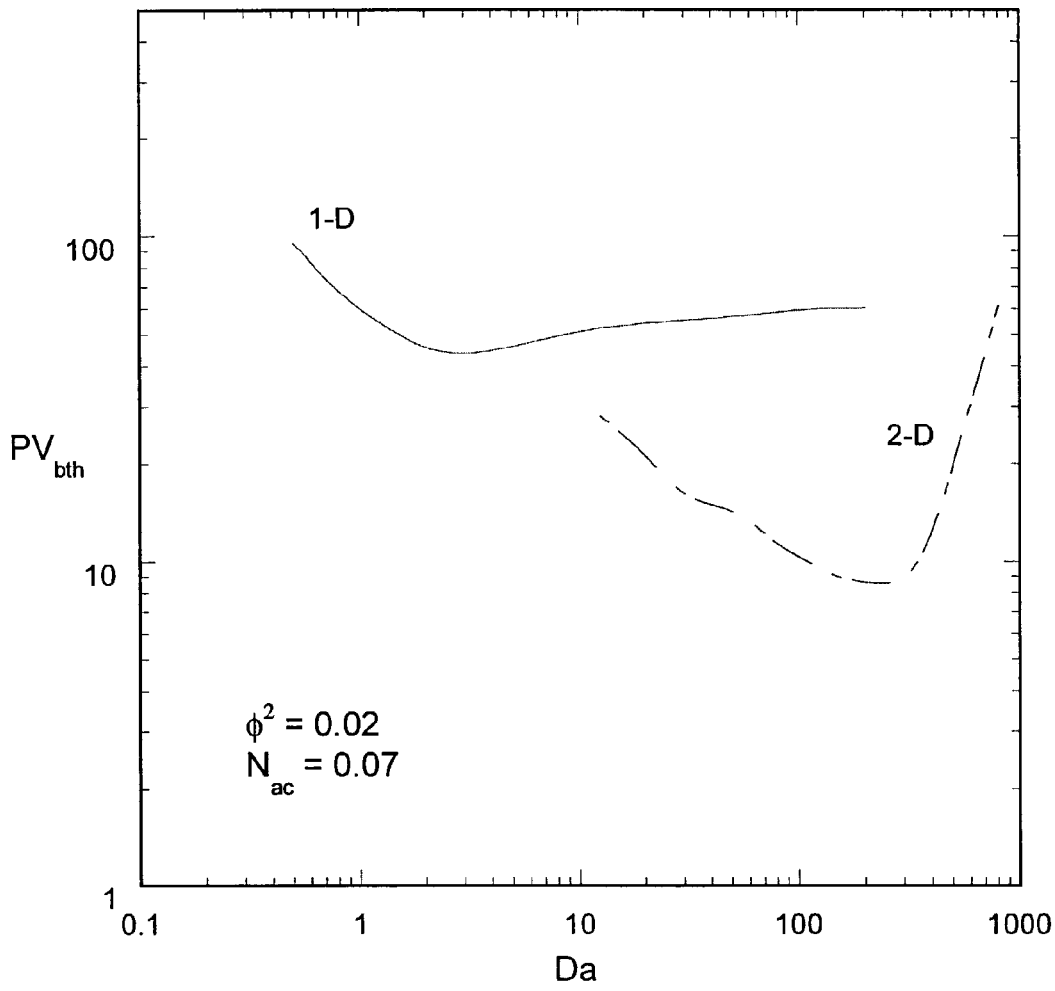
FIG. 14 is a plot showing the 1-D and 2-D model predictions of optimum pore volumes required for breakthrough. The pore volumes required for breakthrough are much lower in 2-D due to channeling effect.

The decrease in pore volumes to breakthrough due to channeling in 2-D is shown in FIG. 14. The parameters $\phi^2$=0.02 and $N_{ac}$=0.07 are maintained the same in both 1-D and 2-D simulations. The aspect ratio ($\alpha_o$) for the 2-D simulation is 0.37. The figure shows a factor five decrease in the optimum breakthrough volume from 1-D to 2-D simulation due to channeling of the flow into the wormholes. It should be noticed that the optimum Damköhler number for the 2-D case is much higher than the 1-D. For the same initial conditions in 1-D and 2-D, increase in the Damköhler number ($Da=k_s a_o L/u_o$) implies a decrease in the injection rate. Thus the injection velocity required for optimal breakthrough is much lower in two dimensions when compared to flow in 1-D. Though the injection velocity is low, channeling produces much higher local velocities as given by Eq. (34). Since this effect is absent in 1-D, the fluid velocity required for optimal breakthrough is much higher.

The above comparisons between 1-D and 2-D results suggest that the pore volumes required for breakthrough for a complete 3-D core scale simulation would be less than the 1-D and 2-D simulations and probably bridge the gap between the experimental and numerically simulated pore volumes. The injection velocity for optimal conditions also would be less than that obtained from the 1-D and 2-D simulations.

Sensitivity of the Results to Various Parameters in the Model and their Effects on Wormhole Structure The dependence of breakthrough time for different mesh sizes has been studied for the case Da=100, $\phi^2=0.02$, $N_{ac}=0.07$ and aspect ratio equal to unity. Different mesh sizes for which the simulations were carried are given below $$N_1*N_2=50*50,\ 80*80,\ 80*100,\ 100*80,\ 100*100.$$

Here $N_1$ is the number of grid points in the flow direction and $N_2$ is the number of grid points in the transverse direction. The dimensionless breakthrough time was observed to be approximately 1.5 for all the cases. Influence of the exponent $\beta$ in the permeability-porosity correlation on the breakthrough time in the wormholing regime is observed to weak. The breakthrough times obtained for different values of $\beta$ are listed below.

| $\beta$ | Breakthrough time |
|---|---|
| 0.8 | 1.73 |
| 1.0 | 1.67 |
| 1.5 | 1.58 |
| 2.0 | 1.82 |

Effect of Heterogeneity

Heterogeneity is introduced into the model as a random porosity field. The sensitivity of the results and the dependence of wormhole structure on initial heterogeneity are investigated using two types of random porosity fields. In the first case initial porosity in the domain is introduced as a random fluctuation of the porosity values about a mean value at each grid point in the domain. The amplitude of the fluctuation is varied between 10%-50% of the mean value. The results obtained for fluctuations of this magnitude are observed to be qualitatively similar. On a scale much larger than the grid spacing, this type of porosity field appears to be more or less uniform or homogeneous. Numerical simulations in 2-D using the above mentioned heterogeneous porosity field show that the model can capture wormhole initiation, fluid leakage, wormhole density and competitive growth of wormholes. However, heterogeneity, when introduced in the above form is observed to produce almost straight wormholes with little deviations in the path. Branching of wormholes is not observed.

In the second case, heterogeneity is introduced at two different scales namely (a) random fluctuation of porosity about a mean value at each grid point (b) random fluctuation of porosity values about a different mean than the former over a set of grid points (scale larger than the scale of the mesh). The simulations with different scales of heterogeneity show that branching, fluid leakage and the curved trajectories of the wormholes observed in the experiments could be a result of different types of heterogeneities present in carbonates.

The acid is diverted into the center of the domain and dissolution gives a straight wormhole. However, when the mean value of porosity at the center of the domain is increased to 0.4, branching is observed. During the initial stages of dissolution, the acid flows into the channel and leaks at the tip. Following this two branches evolve of which one grows much faster than the other and breaks through the core. If an additional low porosity region is introduced in the middle of the domain, the presence of a low porosity region inside the domain can be interpreted as a portion of the core with very low permeability. In this later case, the acid prefers to branch instead of dissolving the rock in the low permeability region. Since such regions of low permeability can occur in carbonates, branches might evolve from the wormhole when it comes in contact with these regions.

The above simulations show that the complex structure of the wormhole observed in the experiments and fluid leakage could be a result of different scales of heterogeneity present in the core. The effect of these heterogeneities on the breakthrough time has not been investigated in a systematic way in the literature. To study the effects of heterogeneities on wormholing and the sensitivity of breakthrough time to heterogeneity, it is required to introduce different types of permeability fields as initial condition to the numerical simulation. One way to introduce different permeability fields is to increase the random fluctuation of permeability about a mean field. However, as stated earlier, this procedure always gives a permeability field that is more or less homogeneous on a scale much larger than the grid scale.

Figure 15A:
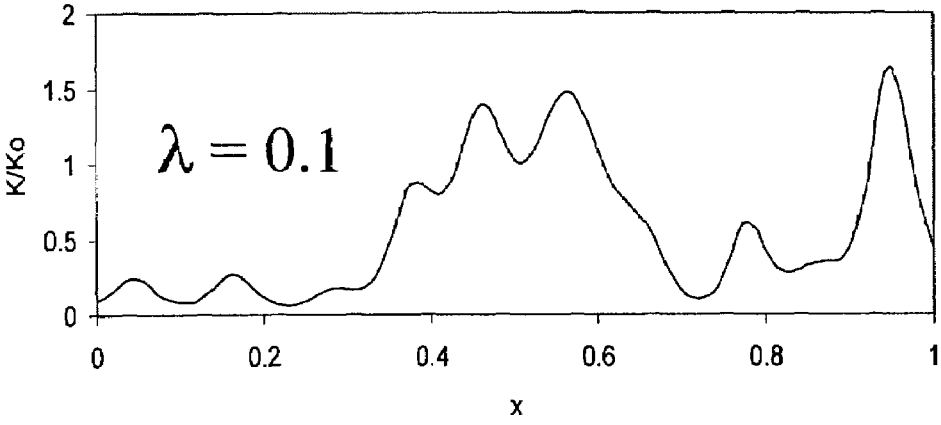
FIG. 15 shows the correlated random permeability fields of different correlation lengths λ generated on a domain of unit length using exponential covariance function.
Figure 15B:
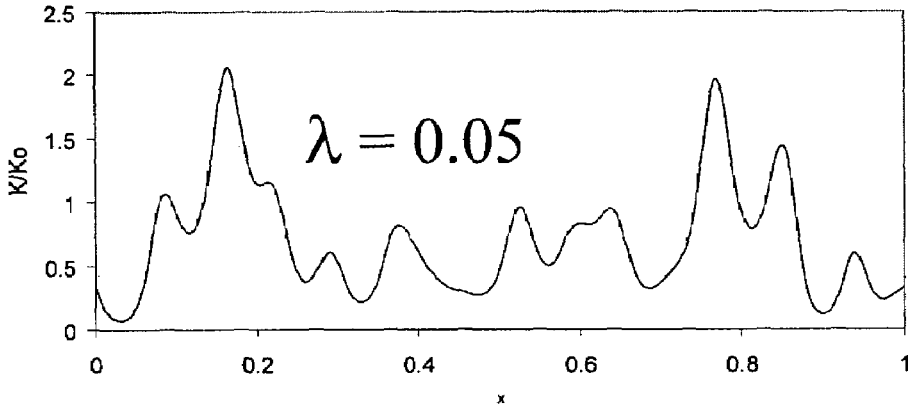
Figure 15C:
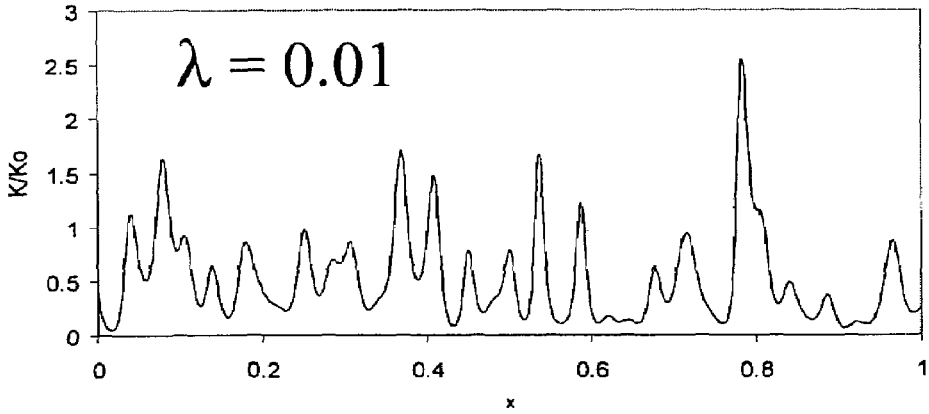

The other approach to generate different permeability fields is to introduce a correlation length $\lambda$ for the permeability field. By changing the correlation length, different scales of heterogeneity can be generated. Thus, locations in the domain that are close to each other have correlated permeability values and for locations separated by distance much greater than $\lambda$, the permeability values are not correlated. The maximum amplitude of the fluctuation of permeability value about the mean at each grid point is controlled by the variance $\sigma^2$ of the permeability distribution. By changing the correlation length $\lambda$ and the variance $\sigma^2$ of the distribution, initial heterogeneities of different length scales can be produced. When the correlation length becomes very small, random permeability field of the first type is produced. Thus the permeability fields generated using the first approach are a special case of the random permeability fields generated using the second method. For example, FIGS. 15(*a*)-15(*c*) show random correlated permeability fields generated on a one-dimensional domain of unit length. The correlation lengths $\lambda$, for FIGS. 15(*a*)-15(*c*) are 0.1, 0.05 and 0.01, respectively. As the correlation length is decreased the permeability field becomes similar to that generated using the first approach. An exponential covariance function with a variance $\sigma^2$ of two is used to generate these 1-D permeability fields. The above procedure offers the advantage of studying the effect of heterogeneities on wormhole formation and structure in a systematic way.

A new averaged model is developed for describing flow and reaction in porous media. The model presented here describes the acidization process as an interaction between processes at two different scales, the Darcy scale and the pore scale. The model may used with different pore scale models that are representative of the structure of different types of rocks without affecting the Darcy scale equations. The new model is heterogeneous in nature and may be used in both the mass transfer and kinetically controlled regimes of reaction. Numerical simulations of the new model for the 1-D case show that the model captures the features of acidization qualitatively. Two-dimensional simulations of the model demonstrate the model's ability to capture wormhole initiation, propagation, fluid leakage and competitive growth of the wormholes. The effect of heterogeneity on wormhole formation can also be studied using different initial porosity fields. The quantity of practical interest, pore volumes required for breakthrough, is found to be a strong function of flow channeling. The simulations presented here are preliminary and the effect of heterogeneity on wormhole formation and structure of wormholes e.g. branching of wormholes, fluid leakage associated with branching etc., have not been completely studied.

Since the model of the present invention allows accurate scale-up, stimulation treatments may be designed by first obtaining a reservoir core, obtaining a set of parameters representative of said reservoir core, said set of parameters including Darcy scale parameters and pore scale parameters and performing the method of modeling according to the present invention. Said set of parameters will preferably include the Sherwood number, the dispersion tensor, the Thiele modulus, and the Peclet number. In addition, data representative of the heterogeneities present in the reservoir core are also collected.

What is claimed is:

1. A method comprising:

modeling a stimulation treatment involving at least one chemical reaction in a porous medium including:

describing the chemical reaction by coupling the reactions and mass transfer occurring at the Darcy scale and at the pore scale;

considering the concentration $c_f$ of a reactant in the pore fluid phase and the concentration of said reactant $c_s$ at the fluid solid interface of a pore;

quantifying a rate of transport of the reactant from a fluid phase to a fluid-solid interface inside the pore by a mass transfer coefficient by taking into account both the diffusive and convective contributions, wherein the diffusive contribution of the mass transfer coefficient is represented by an asymptotic Sherwood ($Sh_\infty$) number for the pore, wherein the dimensionless mass transfer coefficient (Sherwood number Sh) is given by $$Sh=Sh_\infty+bRe_p^{1/2}Sc^{1/3}$$

wherein b is a constant depending on the pore length to pore diameter ratio, $Re_p$ is the pore Reynolds number, and Sc is the Schmidt number; and stimulating a subterranean formation comprising a porous medium based on the modeled stimulation treatment.

2. The method of claim 1, wherein $b=0.7/m^{0.5}$, where m is the pore length to pore diameter ratio.

3. The method of claim 1, wherein the stimulated subterranean formation comprises a carbonate formation.

4. The method of claim 1, wherein stimulating the subterranean formation comprises acidizing the subterranean formation.

5. The method of claim 4, wherein the acidizing of the subterranean formation includes a treatment selected from the group consisting of matrix acidizing and acid fracturing.

6. The method of claim 1, wherein the at least one chemical reaction involves the dissolution of the porous medium.

7. The method of claim 6, wherein the modeling a stimulation treatment includes a description of the dissolution of the porous medium using coupled global and local equations.

8. The method of claim 7, wherein the coupled global and local equations involve a permeability, a dispersion tensor, and average pore radius, and a local mass transfer coefficient.

9. The method of claim 1, wherein the modeling a stimulation treatment further comprises modeling a flow of the reactant using a non-zero divergent velocity field ∇.U.

10. The method of claim 1, further including a use of correlated random fields to account for different scales of heterogeneity.

11. The method of claim 1, wherein stimulating the subterranean formation comprises fracturing the subterranean formation.

12. The method of claim 1, wherein the model comprises a two-scale continuum model.

13. The method of claim 1, wherein the model comprises parameters at an optimum injection rate, the parameters comprising core length, acid concentration, temperature, diffusion and reaction rates.

14. A method comprising:

modeling a stimulation treatment involving at least one chemical reaction in a porous medium including:

describing the chemical reaction by coupling the reactions and mass transfer occurring at the Darcy scale and at the pore scale;

considering the concentration $c_f$ of a reactant in the pore fluid phase and the concentration of said reactant $c_s$ at the fluid solid interface of a pore;

quantifying a rate of transport of the reactant from a fluid phase to a fluid-solid interface inside the pore by a mass transfer coefficient by taking into account both the diffusive and convective contributions, wherein the diffusive contribution of the mass transfer coefficient is represented by an asymptotic Sherwood ($Sh_\infty$) number for the pore, wherein the dimensionless mass transfer coefficient (Sherwood number Sh) is given by $$Sh=Sh_\infty+bRe_p^{1/2}Sc^{1/3}$$

wherein b is a constant depending on the pore length to pore diameter ratio, $Re_p$ is the pore Reynolds number, and Sc is the Schmidt number;

designing a stimulation treatment based on the modeled stimulation treatment; and stimulating a subterranean formation comprising a porous medium based on the modeled stimulation treatment by stimulating the subterranean formation according to the designed stimulation treatment.

15. The method of claim 14, wherein designing the stimulation treatment based on the modeled stimulation treatment includes obtaining a reservoir core, obtaining a set of parameters representative of the reservoir core, wherein the set of parameters includes Darcy scale parameters and pore scale parameters, and wherein modeling the stimulation treatment further includes using the set of parameters representative of the reservoir core.

16. The method of claim 15, wherein the set of parameters representative of the reservoir core further includes data related to the heterogeneities.

17. The method of claim 14, wherein stimulating the subterranean formation comprises fracturing the subterranean formation.

18. The method of claim 14, wherein the model comprises a two-scale continuum model.

19. The method of claim 14, wherein the model comprises parameters at an optimum injection rate, the parameters comprising core length, acid concentration, temperature, diffusion and reaction rates.

20. A method of fracturing a subterranean formation penetrated by a wellbore, the method comprising:

modeling a fracture treatment involving at least one chemical reaction in a porous medium including:

describing the chemical reaction by coupling the reactions and mass transfer occurring at the Darcy scale and at the pore scale;

considering the concentration $c_f$ of a reactant in the pore fluid phase and the concentration of said reactant $c_s$ at the fluid solid interface of a pore;

quantifying a rate of transport of the reactant from a fluid phase to a fluid-solid interface inside the pore by a mass transfer coefficient by taking into account both the diffusive and convective contributions, wherein the diffusive contribution of the mass transfer coefficient is represented by an asymptotic Sherwood($SH_\infty$) number for the pore, wherein the dimensionless mass transfer coefficient(Sherwood number Sh) is given by $$Sh=Sh_\infty+bRe_p^{1/2}Sc^{1/3}$$

wherein b is a constant depending on the pore length to pore diameter ratio, $Re_p$ is the pore Reynolds number, and Sc is the Schmidt number; and, fracturing the subterranean formation by preparing a fracturing fluid and introducing the fluid into the formation based upon the modeled fracturing treatment.

* * * * *